US005786799A

United States Patent [19]

Matsui et al.

[11] Patent Number: 5,786,799

[45] Date of Patent: Jul. 28, 1998

[54] DRIVING METHOD FOR A LIQUID CRYSTAL DISPLAY

[75] Inventors: Kiyohisa Matsui; Norio Yasunishi, both of Yamatokoriyama; Hiromasa Asada; Koki Taniguchi, both of Ikoma; Toshihiro Ohba, Nara, all of Japan

[73] Assignee: Sharp Kabushiki Kaisha, Osaka, Japan

[21] Appl. No.: 531,169

[22] Filed: Sep. 19, 1995

[30] Foreign Application Priority Data

Sep. 20, 1994 [JP] Japan ..... 6-225182

[51] Int. Cl.[6] ..... G09G 3/36

[52] U.S. Cl. ..... 345/94; 345/100

[58] Field of Search ..... 345/87, 94, 95, 345/96, 100, 103, 208, 209, 210

[56] References Cited

U.S. PATENT DOCUMENTS

| | | | |
|---|---|---|---|
| 4,412,214 | 10/1983 | Tanaka et al. | 345/43 |
| 5,420,603 | 5/1995 | Tsuboyama et al. | 345/97 |
| 5,621,425 | 4/1997 | Hoshino et al. | 345/100 |
| 5,627,557 | 5/1997 | Tsuboyama et al. | 345/97 |

FOREIGN PATENT DOCUMENTS

| | | |
|---|---|---|
| 6-27904 | 2/1994 | Japan . |
| 6-27905 | 2/1994 | Japan . |
| 6-27906 | 2/1994 | Japan . |
| 6-27907 | 2/1994 | Japan . |

OTHER PUBLICATIONS

T. Scheffer et al. "Active Addressing Method for High–Contrast Video–Rate STN Displays", *SID 92 Digest*, pp. 228–231.

T. Ruckmongathan et al. "A New Addressing Technique for Fast Responding STN LCDs", *Japan Display*, 1992, pp. 65–67.

S. Ihara et al. "A Color STN–LCD with Improved Contrast, Uniformity,and Response Times" *SID 92 Digest*, pp. 232–235.

*Primary Examiner*—Matthew Luu

*Attorney, Agent, or Firm*—David G. Conlin; Brian L. Michaelis

[57] ABSTRACT

A driving method for a liquid crystal display is provided with the steps of (a) applying a row select voltage to each of the row electrodes simultaneously, the row select voltage corresponding to an element of an orthogonal matrix and being either +1 or −1 ; (b) conducting an exclusive-or operation with respect to each element of a row select vector and a display vector, the row select vector indicating the row select voltages by vector notation and the display vector indicating a display data by the vector notation, and conducting a summation of each exclusive-or operation; (c) applying to the column electrode a voltage of a level which varies depending on the summation so as to simultaneously drive the plurality of rows; and (d) in a case where all the display data correspond to ON display or OFF display in the step (c), assigning the row select voltage, applied to either the selected row electrode having the lowest select voltage among driving voltages within one frame period for the ON display or the selected row electrode having the highest select voltage among the driving voltages within one frame period for the OFF display, to a virtual row electrode outside a display area, and applying a virtual display data to the virtual row electrode.

8 Claims, 22 Drawing Sheets

P0
P1
P2
P3
4
3
4a
4b
4c
4d
4e
4f
4g
4h
4i
4j
4k
4l
4m
4n
4p
4q
4r
301
302
303
304
305
306
307
308
309
310
311
312
313
314
315
w1 d1
w2 d2
w3 d3
w4 d4
w5 d5
w6 d6
w7
w8
w9 d9
w10 d10
w11 d11
w12
w13 d13
w14 d14
w15 d15
VIRTUAL DISPLAY DATA
VIRTUAL DISPLAY DATA
VIRTUAL DISPLAY DATA

DRIVING METHOD FOR A LIQUID CRYSTAL DISPLAY

FIELD OF THE INVENTION

The present invention relates to a driving method for a liquid crystal display (LCD), and particularly relates to a driving method for an LCD in which pixels are disposed in a matrix form and a liquid crystal responds to a root-mean-square (RMS) voltage.

BACKGROUND OF THE INVENTION

In a conventional static matrix-type LCD using TN liquid crystal or STN liquid crystal which responds to an RMS voltage, the following LCD drive method is adopted: a row select voltage is applied to each row electrode so that each row electrode is selected successively one by one among a number of row electrodes (line sequential), while a column voltage, which corresponds to data to be displayed on a pixel on the selected row electrode, is applied to each of column electrodes. In this driving method, in the case where ON display is performed over the whole pixels, a driving voltage having a waveform shown in FIG. 7(*a*) is applied to each pixel of each intersection of the row electrodes and the column electrodes. In contrast, in the case where OFF display is performed over the whole pixels, a driving voltage having a waveform shown in FIG. 8(*a*) is applied to each pixel.

Latch pulse (LP) shown in FIGS. 7(*b*) and 8(*b*) is a pulse signal (output enable signal), which is generated by a liquid crystal driver. The latch pulse (LP) is provided for outputting the display data, which has been both sampled and latched 1 horizontal scanning period before, in synchronization with the rising or the falling of such a pulse signal.

During the driving of the LCD in accordance with the foregoing drive method, in the case of ON display, the liquid crystal molecules behave within one frame period as follows. More specifically, the liquid crystal molecules rise up in response to only a voltage $V_{op}$ or $-(V_{op})$ during the first horizontal scanning period (i.e., the selected period of the row electrode) and thereafter maintain their states according to an RMS response during a non-selected period when voltages $V_{op}/a$ and $-(V_{op}/a)$ are alternately applied. In contrast, in the case of OFF display, the liquid crystal molecules behave within one frame period as follows. More specifically, the liquid crystal molecules rise up in response to only a voltage $(1-2/a)\ V_{op}$ or $-(1-2/a)\ V_{op}$ during the first horizontal scanning period and thereafter maintain their states according to the RMS response during a non-selected period when voltages $(V_{op})/a$ and $-(V_{op})/a$ are alternately applied.

However, the liquid crystal molecule, in fact, tends to change its molecule axis in accordance with the applied voltage with an increase in its response time. Consequently, it remarkably occurs that, in a fast responding LCD, the liquid crystal molecule has difficulty in maintaining its own state according to the RMS response and responds only to a peak voltage. This is so-called a frame response phenomenon which causes the LCD's contrast to decrease.

In order to eliminate such a trade-off, in the LCDs, between the fast response and the contrast ratio, three arts have proposed the following LCD drive methods:

(1) T. J. Sheffer, B. Clinton: "Active Adressing Method for High-Contrast Video-Rate STN Displays" SID 92 DIGEST p228, (2) T. N. Ruckmongathan, T. Kuwata, T. Ohnishi, S. Ihara, H. Koh, Y. Nakagawa: "A New Adressing Technique for Fast Responding STN LCDs" JAPAN DISPLAY '92 p65, and (3) S. Ihara, Y. Sugimoto, Y. Nakagawa: "A Color STN-LCD with Improved Contrast, Uniformity, and Response Times" SID 92 DIGEST p232.

According to the driving method disclosed in the above arts (2) and (3), the frame response phenomenon are suppressed by (a) simultaneously selecting a plurality of row electrodes so as to apply row select voltages to such selected row electrodes and (b) generating a plurality of row select voltages each having a peak voltage within a single frame period. This driving principle is based on the orthogonal transformation of picture data, using the orthogonal matrix such as Hadamard matrix and Walsh matrix.

To put it concretely, as shown in FIGS. 9 and 10, each row select voltage has a voltage level of either +V or −V and is generated at a specified interval T. In addition, the row select voltage corresponds to a column element vector of Kth-order orthogonal matrix (K indicates the power of 2 of not less than J which is the number of row electrodes simultaneously selected) whose element is either +1 or −1, as shown in Tables 1 through 3.

Table 1 shows 8th-order Walsh matrix in which the column element vector matches each period $T_1$ through $T_8$ divided into the specified interval (period T) at each row of the first row $W_0$ through the eighth row $W_7$. Table 2 shows 7×8 type 8th-order Walsh matrix without the first row $W_0$ in Table 1. Table 3 shows the matrix in which the polarity of four rows ($W_2$, $W_4$, $W_6$, and $W_7$) in the Walsh matrix shown in Table 2 is reversed. Even though the polarities of several rows are reversed in an orthogonal matrix, the orthogonal matrix is still capable of orthogonal transformation without losing its orthogonality.

Accordingly, the matrix shown in Table 3 also has orthogonality. Moreover, the row reversing its polarity can be optionally selected; only the row $W_1$ may be selected, or the rows $W_3$, $W_4$, and $W_5$ may be selected.

In the matrix shown in Table 1, the first row $W_0$ has only one level of row select voltage, i.e., +V or −V. So, in the row $W_0$, the alternation of the applied voltage is required by reversing the polarity of element( +1,−1) of the row $W_0$ every several frame periods, in order to prevent deterioration of liquid crystal molecules due to the application of a dc voltage. In the matrices shown in Tables 2 and 3, the foregoing alternation is not required because they don't have the first row $W_0$.

TABLE 1

| | $T_1$ | $T_2$ | $T_3$ | $T_4$ | $T_5$ | $T_6$ | $T_7$ | $T_8$ |
|---|---|---|---|---|---|---|---|---|
| $W_0$ | +1 | +1 | +1 | +1 | +1 | +1 | +1 | +1 |
| $W_1$ | +1 | +1 | +1 | +1 | −1 | −1 | −1 | −1 |
| $W_2$ | +1 | +1 | −1 | −1 | −1 | −1 | +1 | +1 |
| $W_3$ | +1 | +1 | −1 | −1 | +1 | +1 | −1 | −1 |
| $W_4$ | +1 | −1 | −1 | +1 | +1 | −1 | −1 | +1 |
| $W_5$ | +1 | −1 | −1 | +1 | −1 | +1 | +1 | −1 |
| $W_6$ | +1 | −1 | +1 | −1 | −1 | +1 | −1 | +1 |
| $W_7$ | +1 | −1 | +1 | −1 | +1 | −1 | +1 | −1 |

TABLE 2

| | $T_1$ | $T_2$ | $T_3$ | $T_4$ | $T_5$ | $T_6$ | $T_7$ | $T_8$ |
|---|---|---|---|---|---|---|---|---|
| $W_1$ | +1 | +1 | +1 | +1 | −1 | −1 | −1 | −1 |
| $W_2$ | +1 | +1 | −1 | −1 | −1 | −1 | +1 | +1 |
| $W_3$ | +1 | +1 | −1 | −1 | +1 | +1 | −1 | −1 |
| $W_4$ | +1 | −1 | −1 | +1 | +1 | −1 | −1 | +1 |
| $W_5$ | +1 | −1 | −1 | +1 | −1 | +1 | +1 | −1 |
| $W_6$ | +1 | −1 | +1 | −1 | −1 | +1 | −1 | +1 |
| $W_7$ | +1 | −1 | +1 | −1 | +1 | −1 | +1 | −1 |

TABLE 3

| | $T_1$ | $T_2$ | $T_3$ | $T_4$ | $T_5$ | $T_6$ | $T_7$ | $T_8$ |
|---|---|---|---|---|---|---|---|---|
| $W_1$ | +1 | +1 | +1 | +1 | −1 | −1 | −1 | −1 |
| $W_2$ | −1 | −1 | +1 | +1 | +1 | +1 | −1 | −1 |
| $W_3$ | +1 | +1 | −1 | −1 | +1 | +1 | −1 | −1 |
| $W_4$ | −1 | +1 | +1 | −1 | −1 | +1 | +1 | −1 |
| $W_5$ | +1 | −1 | −1 | +1 | −1 | +1 | +1 | −1 |
| $W_6$ | −1 | +1 | −1 | +1 | +1 | −1 | +1 | −1 |
| $W_7$ | −1 | +1 | −1 | +1 | −1 | +1 | −1 | +1 |

The above driving method is carried out by an LCD device which is provided with an orthogonal function producer 1, a frame memory 2, a gate array 3, an adder 4, column drivers 5 (recognized as CD in FIG. 2), row drivers 6 (recognized as RD in FIG. 2), and an LCD 7 (see FIG. 2).

In the LCD device, the orthogonal function producer 1 generates a row signal in accordance with a row select voltage with the use of the orthogonal matrix in Table 3. Exclusive-OR operations are conducted by the gate array 3 with respect to corresponding elements between a row element vector and a display vector. The row element vector has the element of the row signal, while the display vector has the element of display data from the frame memory 2. The adder 4 conducts the summation of the respective results of such exclusive-OR operations (orthogonal transformation), and outputs values of $P_0$ through $P_2$ corresponding to respective voltage levels of $V_0$ through $V_7$ (see Table 4). The column drivers 5 output the column voltages in response to the values of $P_0$ through $P_2$, whereas the row drivers 6 output the row select voltages in response to the row signals in synchronization with the output of column voltages.

TABLE 4

| $P_2$ | $P_1$ | $P_0$ | VOLTAGE LEVEL |
|---|---|---|---|
| 0 | 0 | 0 | $V_0$ |
| 0 | 0 | 1 | $V_1$ |
| 0 | 1 | 0 | $V_2$ |
| 0 | 1 | 1 | $V_3$ |
| 1 | 0 | 0 | $V_4$ |
| 1 | 0 | 1 | $V_5$ |
| 1 | 1 | 0 | $V_6$ |
| 1 | 1 | 1 | $V_7$ |

TABLE 5

| ELEMENT | CORRESPONDING ROWS | | |
|---|---|---|---|
| $d_1$ | The 1st row, | The 8th row, . . . , | The (N-6)th row |
| $d_2$ | The 2nd row, | The 9th row, . . . , | The (N-5)th row |
| $d_3$ | The 3rd row, | The 10th row, . . . , | The (N-4)th row |
| $d_4$ | The 4th row, | The 11th row, . . . , | The (N-3)th row |
| $d_5$ | The 5th row, | The 12th row, . . . , | The (N-2)th row |
| $d_6$ | The 6th row, | The 13th row, . . . , | The (N-1)th row |
| $d_7$ | The 7th row, | The 14th row, . . . , | The Nth row |

In the logic operations by the gate array 3 and the adder 4, it is assumed that the row select voltage +V is +1 (for logic "1") and the row select voltage −V is 0 (for logic "0"). As to the display data, ON data corresponds to +1 (for logic "1") and OFF data corresponds to 0 (for logic "0").

As shown in FIG. 11, elements $w_1$ through $w_7$ of the column element vector in Table 3 are inputted to one input terminal of the respective EX-OR gates 31 through 37 of the gate array 3, and elements $d_1$ through $d_7$ of the display vector are inputted to the other input terminal thereof. The elements $d_1$ through $d_7$ match the display data of the respective rows in the LCD 7 as shown in Table 5.

Other LCD drive methods in which a plurality of row electrodes are simultaneously selected are also disclosed in, for example, the Japanese unexamined patent publication Nos. 6-27904/1994, 6-27905/1994, 6-27906/1994, and 6-27907/1994.

Here, if 7 row electrodes are simultaneously selected as shown in FIG. 12, the driving voltages (the difference between the row select voltage and the column voltage within one frame period) have respectively such waveforms as shown in FIGS. 13 through 16. FIGS. 13 and 15 show the waveforms in the case of the ON display over the whole pixels, while FIGS. 14 and 16 show the waveforms in the case of the OFF display over the whole pixels.

FIGS. 13 and 14 respectively show one example of the driving voltage waveform in the case where the above transformation is carried out using the 8th-order Walsh matrix in Table 2. These two waveforms are resulting waveforms from the row select voltage waveform in FIG. 9 and the column voltage waveforms shown in FIGS. 17(*a*) and 17(*b*).

In the column voltage waveforms, the voltage level is selected among the eight-stage voltage levels $V_0$ through $V_7$ as shown in Table 4. In the case of the ON display over the whole pixels, as shown in FIG. 17(*a*), the column voltage has the lowest voltage level $V_D$ at the beginning of one frame period, and then, reaches the voltage level $V_4$ a little bit higher than 0. In the case of the OFF display over the whole pixels, as shown in FIG. 17(*b*), the column voltage has the highest voltage level $V_7$ at the beginning of one frame period, and then, reaches the voltage level $V_3$ a little bit lower than 0.

FIGS. 15 and 16 respectively show one example of the driving voltage waveform in the case where the above transformation is carried out using the 8th-order Walsh matrix in Table 3. These two waveforms are resulting waveforms from the row select voltage waveform in FIG. 10 and the column voltage waveforms shown in FIGS. 18(*a*) and 18(*b*).

In these column voltage waveforms, the voltage level is selected among the voltage levels $V_0$ through $V_7$ like the waveforms shown in FIGS. 17(*a*) and 17(*b*). In the case of the ON display over the whole pixels, as shown in FIG. 18(*a*), the column voltage changes so that the voltage levels $V_4$ and $V_2$ alternate at a fixed period, and thereafter the column voltage reaches, at the end of one frame period, the voltage level $V_6$ one stage lower than $V_7$. In the case of OFF display over the whole pixels, as shown in FIG. 18(*b*), the column voltage changes so that the voltage levels $V_3$ and $V_5$ alternate at a fixed period, and thereafter the column voltage reaches, at the end of one frame period, the voltage level $V_1$ one stage higher than $V_0$.

If 7 rows are simultaneously selected, the number K of the Kth-order orthogonal matrix to generate the row select voltage, is 8 as the power of 2 of not less than 7 (selected rows). Therefore, in the case where 7 rows are simultaneously selected, arbitrary 7 rows can be selected within 8th-order orthogonal matrix and the number of the row select voltages is 8 within one frame period.

The driving voltage waveform shown in FIG. 13, however, becomes like a waveform of the line sequential scanning method such as the multiplex drive or the duty drive. In other words, one peak voltage $V_p$ exists at the beginning period $t_1$ of one frame period. The liquid crystal molecules is likely to respond to such a peak voltage $V_p$, thereby presenting the problem that the frame response phenomenon occurs so as to reduce the contrast of the display.

In contrast, the driving voltage waveforms shown in FIGS. 15 and 16, unlike the foregoing ones, are not unevenly distributed within a specified period T (the period required for switching the column elements of the orthogonal matrix) of one frame period. Namely, since the driving voltage waveforms of FIGS. 15 and 16 are distributed uniformly over the single frame period, the frame response phenomenon is relaxed so as to suppress the reduction of the contrast.

However, in such a case, the selected row $L_7$, among the simultaneously selected rows $L_1$ through $L_7$, of the driving voltage waveforms has a unique select voltage at the period $t_8$. Such a unique select voltage appears as the voltage $V_f$ in the row $L_7$ at the period $t_8$ during the ON display over the whole pixels as shown in FIG. 15. The voltage $V_f$ is the lowest of all the select voltages including other rows $L_1$ through $L_6$. Such an appearance of voltage $V_f$ causes the liquid crystal molecules to shift to the OFF state, thereby diminishing the luminance in the selected row $L_7$. In the other selected rows $L_1$ through $L_6$, all the select voltages always have the polarity which is the reverse of the voltage $V_f$ at the period $t_8$. These select voltages, in contrast, cause the liquid crystal molecules to shift to the ON state. For that reason, the luminance becomes higher in the other selected rows $L_1$ through $L_6$ than in the selected row $L_7$ having the voltage $V_f$.

Consequently, in the case of the ON display over the whole pixels, the selected rows having high luminance and the selected row causing the slight OFF display are mixed, thereby resulting in that the display has a contrast stripe every selected rows.

On the other hand, in the case of the OFF display as shown in FIG. 16, the selected row $L_7$, among the simultaneously selected rows $L_1$ through $L_7$, of the driving voltage waveforms has a unique select voltage at the period $t_8$. Such a unique select voltage appears as the voltage $V_n$, in the row $L_7$ at the period $t_8$ in the case of the OFF display over the whole pixels. Such voltage $V_n$ causes the display of the row $L_7$ to have contrast with a slight ON level because the voltage $V_n$ causes the liquid crystal molecules to shift to the ON state. In the other selected rows $L_1$ through $L_6$, all the select voltages always have the polarity which is the reverse of the voltage $V_n$ at the period $t_8$. These select voltages cause the liquid crystal molecules to shift to the OFF state so as to be uniformly displayed as they are.

Consequently, in the case of the OFF display over the whole pixels, the selected rows having the OFF display and the selected row causing the slight ON display are mixed, thereby resulting in that the display has a contrast stripe every selected rows.

As described above, in the case where 7 rows are simultaneously selected, there exists certainly one unique voltage ($V_f$ or $V_n$) in one row within one frame period, when each polarity (+V,−V) of plural rows of the orthogonal matrix indicative of the row select voltages is reversed. Furthermore, there are some cases (described later) where more than two unique voltages exist within one frame period in accordance with the way to reverse the rows of the orthogonal matrix, if the number of rows selected simultaneously is more than 7.

For example, if 8 rows are simultaneously selected, it is possible to drive an LCD using the 8th-order Walsh matrix in Table 1. In this case, since the first row $W_0$ of the 8th-order Walsh matrix is used, it should be noted that the alternation of applied voltage is needed by means of reversing the polarity of the elements of the first row $W_0$ every several frame periods.

FIGS. 19(*a*) and 19(*b*) show the driving voltage waveforms of this drive in the case of ON display and OFF display over the whole pixels respectively. As shown in FIG. 19(*a*), each of two selected rows $L_0$ and $L_7$ has the unique voltage level $V_f$ within one frame period, and thus the display has two contrast stripes every selected rows in the same reason as the above described, in the case of the ON display over the whole pixels. Also in the case of the OFF display over the whole pixels, each of two selected rows $L_0$ and $L_7$ has the unique voltage level $V_n$ within one frame period, and thus the display has two contrast stripes every selected rows (see FIG. 19(*b*)).

In the case of such a fast responding LCD that the response time of liquid crystal molecules is not more than 100 ms, or in the case of an LCD which is driven with high duty of not less than hundreds of duty, the liquid crystal molecules come to respond sensitively to each of the eight select voltages within one frame period in the above LCD drive in which 7 or 8 rows are simultaneously selected. Thus, the rising and falling responses of the liquid crystal molecules remarkably occur within one frame period, thereby causing the contrast reduction.

FIG. 20 is a graph showing the relation between the number L of rows selected simultaneously and the contrast, given in Table 1 of the above document (2). In this graph, the contrast value is normalized so that the contrast value is 1 when L=1. As clear from the solid line of this graph, no contrast change occurs when the number L of the rows selected simultaneously is not less than 7 for an LCD in which the response time of the liquid crystal molecules is approximately 100 ms.

But, in the case of such a fast responding LCD that the response time of the liquid crystal molecules is not more than 100 ms, or in the case of an LCD which is driven with high duty of not less than hundreds of duty, the relation between the number L and the contrast is expected to shift from the solid line to the broken line as shown in FIG. 20. In this case, it is possible to relax the rising and falling responses of the molecule axis of the liquid crystal within 1 frame period so as to obtain the high contrast by means of an increase in both the number L of rows selected simultaneously and the number of the select voltages within one frame period.

The following description deals with an example of an LCD drive in which 15 rows are simultaneously selected.

Table 7 shows 15×16 matrix used in this drive. In this matrix, the row $W_0$ is removed from the 16×16 Walsh matrix shown in Table 6 and, among the resultant 15 rows (the first row $W_1$ through the 15th row $W_{15}$), the polarity of the components of 6 rows is reversed as compared to the matrix in Table 6. The 6 rows are the first row $W_1$, the 4th row $W_4$, the 5th row $W_5$, the 7th row $W_7$, the 9th row $W_9$ and the 13th row $W_{13}$.

In the LCD drive in which 15 rows are simultaneously selected, it is required that the gate array 3 is provided with fifteen EX-OR gates 301 through 315, as shown in FIG. 22. Elements $w_1$ through $w_{15}$ of the column element vector in Table 7 are inputted to one input terminal of the respective EX-OR gates 301 through 315 of the gate array 3, and elements $d_1$ through $d_{15}$ of the display vector are inputted to the other input terminal thereof. Exclusive-OR operation is conducted by the respective EX-OR gates 301 through 315 with respect to corresponding elements. The adder 4 conducts the summation of the respective results of such exclusive-OR operations. In other words, the number of mismatches of the respective exclusive-OR operations is counted by the adder 4, and the adder 4 outputs four values of $P_0$ through $P_3$ corresponding to sixteen-stage voltage levels for generating the column voltage. The column drivers output the column voltages in response to the four values of $P_0$ through $P_3$, whereas the row drivers output the row select voltages in response to the row signals in synchronization with the output of the column voltages by the column drivers.

FIGS. 21(*a*) and 21(*b*) show an example of a driving voltage waveform in this drive in which a predetermined transformation is carried out using the above matrix. FIG. 21(*a*) is an example of a waveform for ON display, while FIG. 21(*b*) is an example of a waveform for OFF display.

TABLE 6

| | $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ | $T_{14}$ | $T_{15}$ | $T_{16}$ |
|---|---|---|---|---|---|---|---|---|---|---|---|---|---|---|---|---|
| $W_0$ | +1 | +1 | +1 | +1 | +1 | +1 | +1 | +1 | +1 | +1 | +1 | +1 | +1 | +1 | +1 | +1 |
| $W_1$ | +1 | −1 | +1 | −1 | +1 | −1 | +1 | −1 | +1 | −1 | +1 | −1 | +1 | −1 | +1 | −1 |
| $W_2$ | +1 | +1 | −1 | −1 | +1 | +1 | −1 | −1 | +1 | +1 | −1 | −1 | +1 | +1 | −1 | −1 |
| $W_3$ | +1 | −1 | −1 | +1 | +1 | −1 | −1 | +1 | +1 | −1 | −1 | +1 | +1 | −1 | −1 | +1 |
| $W_4$ | +1 | +1 | +1 | +1 | −1 | −1 | −1 | −1 | +1 | +1 | +1 | +1 | −1 | −1 | −1 | −1 |
| $W_5$ | +1 | −1 | +1 | −1 | −1 | +1 | −1 | +1 | +1 | −1 | +1 | −1 | −1 | +1 | −1 | +1 |
| $W_6$ | +1 | +1 | −1 | −1 | −1 | −1 | +1 | +1 | +1 | +1 | −1 | −1 | −1 | −1 | +1 | +1 |
| $W_7$ | +1 | −1 | −1 | +1 | −1 | +1 | +1 | −1 | +1 | −1 | −1 | +1 | −1 | +1 | +1 | −1 |
| $W_8$ | +1 | +1 | +1 | +1 | +1 | +1 | +1 | +1 | −1 | −1 | −1 | −1 | −1 | −1 | −1 | −1 |
| $W_9$ | +1 | −1 | +1 | −1 | +1 | −1 | +1 | −1 | −1 | +1 | −1 | +1 | −1 | +1 | −1 | +1 |
| $W_{10}$ | +1 | +1 | −1 | −1 | +1 | +1 | −1 | −1 | −1 | −1 | +1 | +1 | −1 | −1 | +1 | +1 |
| $W_{11}$ | +1 | −1 | −1 | +1 | +1 | −1 | −1 | +1 | −1 | +1 | +1 | −1 | −1 | +1 | +1 | −1 |
| $W_{12}$ | +1 | +1 | +1 | +1 | −1 | −1 | −1 | −1 | −1 | −1 | −1 | −1 | +1 | +1 | +1 | +1 |
| $W_{13}$ | +1 | −1 | +1 | −1 | −1 | +1 | −1 | +1 | −1 | +1 | −1 | +1 | +1 | −1 | +1 | −1 |
| $W_{14}$ | +1 | +1 | −1 | −1 | −1 | −1 | +1 | +1 | −1 | −1 | +1 | +1 | +1 | +1 | −1 | −1 |
| $W_{15}$ | +1 | −1 | −1 | +1 | −1 | +1 | +1 | −1 | −1 | +1 | +1 | −1 | +1 | −1 | −1 | +1 |

TABLE 7

| | $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ | $T_{14}$ | $T_{15}$ | $T_{16}$ |
|---|---|---|---|---|---|---|---|---|---|---|---|---|---|---|---|---|
| $W_1$ | −1 | +1 | −1 | +1 | −1 | +1 | −1 | +1 | −1 | +1 | −1 | +1 | −1 | +1 | −1 | +1 |
| $W_2$ | +1 | +1 | −1 | −1 | +1 | +1 | −1 | −1 | +1 | +1 | −1 | −1 | +1 | +1 | −1 | −1 |
| $W_3$ | +1 | −1 | −1 | +1 | +1 | −1 | −1 | +1 | +1 | −1 | −1 | +1 | +1 | −1 | −1 | +1 |
| $W_4$ | −1 | −1 | −1 | −1 | +1 | +1 | +1 | +1 | −1 | −1 | −1 | −1 | +1 | +1 | +1 | +1 |
| $W_5$ | −1 | +1 | −1 | +1 | +1 | −1 | +1 | −1 | −1 | +1 | −1 | +1 | +1 | −1 | +1 | −1 |
| $W_6$ | +1 | +1 | −1 | −1 | −1 | −1 | +1 | +1 | +1 | +1 | −1 | −1 | −1 | −1 | +1 | +1 |
| $W_7$ | −1 | +1 | +1 | −1 | +1 | −1 | −1 | +1 | −1 | +1 | +1 | −1 | +1 | −1 | −1 | +1 |
| $W_8$ | +1 | +1 | +1 | +1 | +1 | +1 | +1 | +1 | −1 | −1 | −1 | −1 | −1 | −1 | −1 | −1 |
| $W_9$ | −1 | +1 | −1 | +1 | −1 | +1 | −1 | +1 | +1 | −1 | +1 | −1 | +1 | −1 | +1 | −1 |
| $W_{10}$ | +1 | +1 | −1 | −1 | +1 | +1 | −1 | −1 | −1 | −1 | +1 | +1 | −1 | −1 | +1 | +1 |
| $W_{11}$ | +1 | −1 | −1 | +1 | +1 | −1 | −1 | +1 | −1 | +1 | +1 | −1 | −1 | +1 | +1 | −1 |
| $W_{12}$ | +1 | +1 | +1 | +1 | −1 | −1 | −1 | −1 | −1 | −1 | −1 | −1 | +1 | +1 | +1 | +1 |
| $W_{13}$ | −1 | +1 | −1 | +1 | +1 | −1 | +1 | −1 | +1 | −1 | +1 | −1 | −1 | +1 | −1 | +1 |
| $W_{14}$ | +1 | +1 | −1 | −1 | −1 | −1 | +1 | +1 | −1 | −1 | +1 | +1 | +1 | +1 | −1 | −1 |
| $W_{15}$ | +1 | −1 | −1 | +1 | −1 | +1 | +1 | −1 | −1 | +1 | +1 | −1 | +1 | −1 | −1 | +1 |

Here, there appear unique voltages $V_f$ in the selected rows $L_7$, $L_8$, and $L_{12}$ in the waveform for the ON display in FIG. 21(*a*). Therefore, in the case of the ON display over the whole pixels of the LCD, the display has three contrast stripes every 15 rows. In contrast, there appear unique voltages $V_n$ in the selected rows $L_7$, $L_8$, and $L_{12}$ in the waveform for OFF display in FIG. 21(*b*). Therefore, in the case of the OFF display over the whole pixels of the LCD, the display has three contrast stripes every 15 rows, too.

The above-mentioned ON display includes half tone display which can be obtained by modulation such as frame rate control modulation, pulse width modulation, and voltage amplitude modulation.

SUMMARY OF THE INVENTION

The present invention is made in the light of the foregoing deficiencies. Namely, it is an object of the present invention to avoid the occurrence of unique voltages $V_f$ and $V_n$ as well as the occurrence of the frame response phenomenon.

In order to achieve the foregoing object, according to the present invention, in a driving method for a liquid crystal display having a liquid crystal, the liquid crystal responding to a root-mean-square voltage and being disposed between a plurality of row electrodes and a plurality of column electrodes, the row and column electrodes being arranged in a matrix form, the following steps are carried out: (a) applying a row select voltage to each of the row electrodes simultaneously, the row select voltage corresponding to an element of an orthogonal matrix and being either +1 or −1; (b) conducting an exclusive-or operation with respect to each element of a row select vector and a display vector, the row select vector indicating the row select voltages by vector notation and the display vector indicating a display data by the vector notation, and conducting a summation of each exclusive-or operation; (c) applying to the column electrode a voltage of a level which varies depending on the above summation so as to simultaneously drive the plurality of row electrodes; and (d) in a case where all the display data correspond to ON display or OFF display in the step (c), assigning the row select voltage, applied to either the selected row electrode having the lowest select voltage among driving voltages within one frame period for the ON display or the selected row electrode having the highest select voltage among the driving voltages within one frame period for the OFF display, to a virtual row electrode outside a display area, and applying a virtual display data to the virtual row electrode.

Furthermore, it is within the scope of the present method to make the number of the virtual row electrode plural.

According to the present method, the virtual display data is included in the display data, and the row select voltage, applied to either a selected row electrode having the lowest select voltage (unique voltage) among driving voltages or a selected row electrode having the highest select voltage (unique voltage) among the driving voltages, is assigned to the virtual row electrode. When a voltage of a level, which varies depending on the summation of each exclusive-or operation with respect to each element of the row select vector and the display vector, is applied to the column electrode so as to simultaneously drive the plurality of row electrodes, the contrast stripe due to the unique voltage can be sent out of the display area.

Therefore, no selected row electrodes with a slight OFF display is mixed during the ON display, and no selected row electrodes with a slight ON display is mixed during the OFF display. So, it is possible (1) to take full advantage of the characteristic which is obtainable by simultaneously selecting so as to drive a plurality of row electrodes, the characteristic eliminating the trade-off in the LCDs between the fast response and the contrast, and (2) to realize the liquid crystal display with uniformity and high picture quality.

In addition, in the case where there are three selected row electrodes each having the unique voltage as the above-mentioned case where 15 row electrodes are simultaneously selected, the data concerning these three row electrodes can be treated as those of a plurality of virtual row electrodes which are outside the real display area. Accordingly, it is possible, like the foregoing case, to realize the liquid crystal display with uniformity and high picture quality by making the number of the assumed virtual row electrode plural.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

BRIEF DESCRIPTION OF THE DRAWINGS

FIG. 1(*b*) is a circuit diagram showing the more detailed structure of the adder.

FIG. 3(*b*) is an explanatory diagram showing the correlation between each row and the selected rows in the case where 7 rows are simultaneously selected in the present LCD drive method.

FIG. 7(*b*) is a waveform chart showing the pulse waveform of output enable signal which is generated by a liquid crystal driver.

FIG. 8(*b*) is a waveform chart showing the pulse waveform of output enable signal which is generated by a liquid crystal driver.

FIG. 17(*b*) is a waveform chart showing the waveform of the column voltage for OFF display over the whole pixels corresponding to the row select voltage of FIG. 9.

FIG. 18(*b*) is a waveform chart showing the waveform of the column voltage for OFF display over the whole pixels corresponding to the row select voltage of FIG. 10.

FIG. 19(*b*) is a waveform chart showing the waveform of the driving voltage for OFF display over the whole pixels in the case where there is the unique voltage in each of two rows.

FIG. 21(*b*) is a waveform chart showing the waveform of the driving voltage for OFF display over the whole pixels in the case where 15 rows are simultaneously selected.

DESCRIPTION OF THE EMBODIMENTS

Figures 1A, 1B:
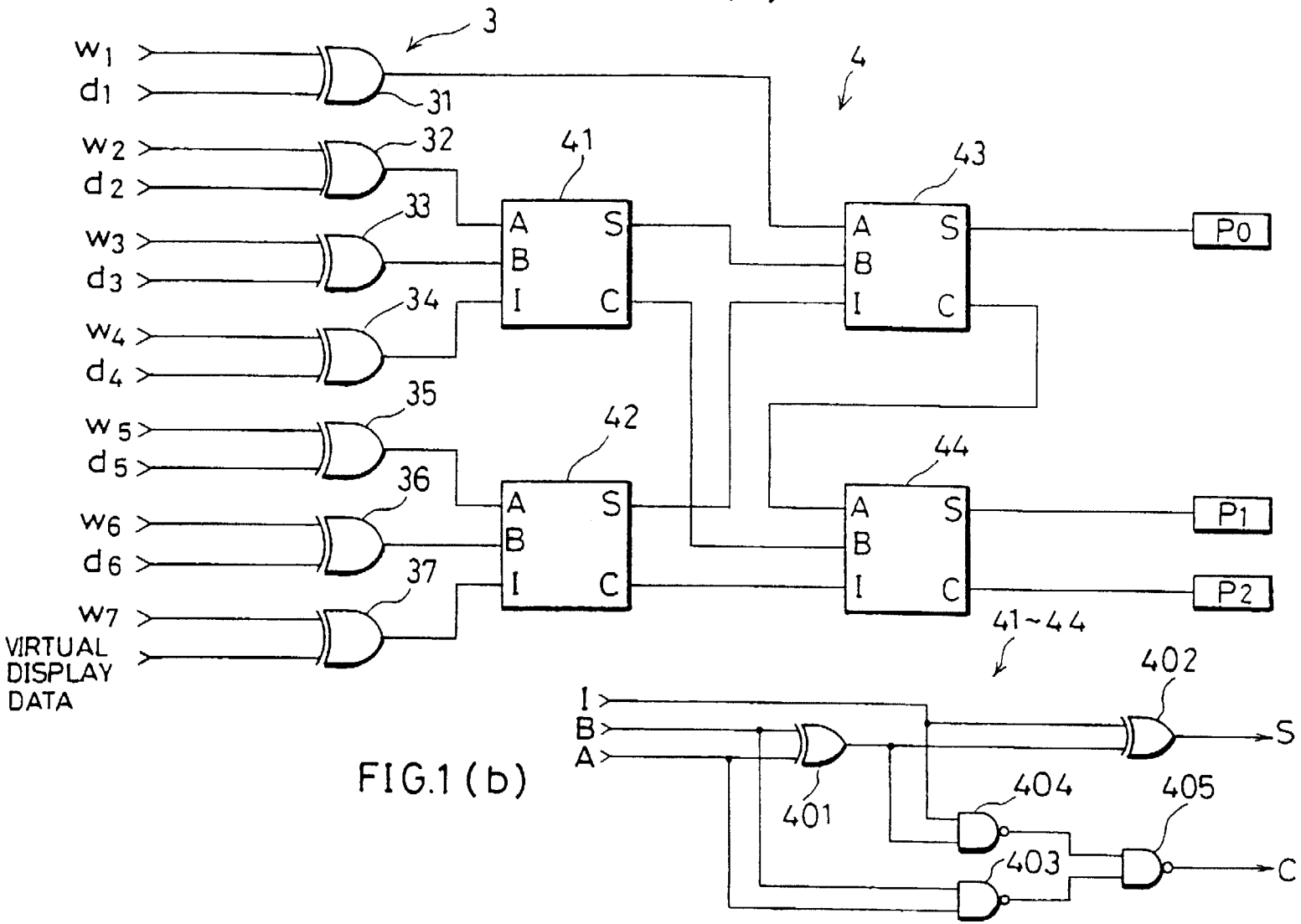
FIG. 1(*a*) is a block diagram showing the structure of both a gate array and an adder in an LCD device for realizing an LCD drive method in accordance with one embodiment of the present invention.

The following description deals with one embodiment and another embodiment of the present invention with reference to FIGS. 1(*a*) and 1(*b*), and FIGS. 2 through 6.

Figure 2:
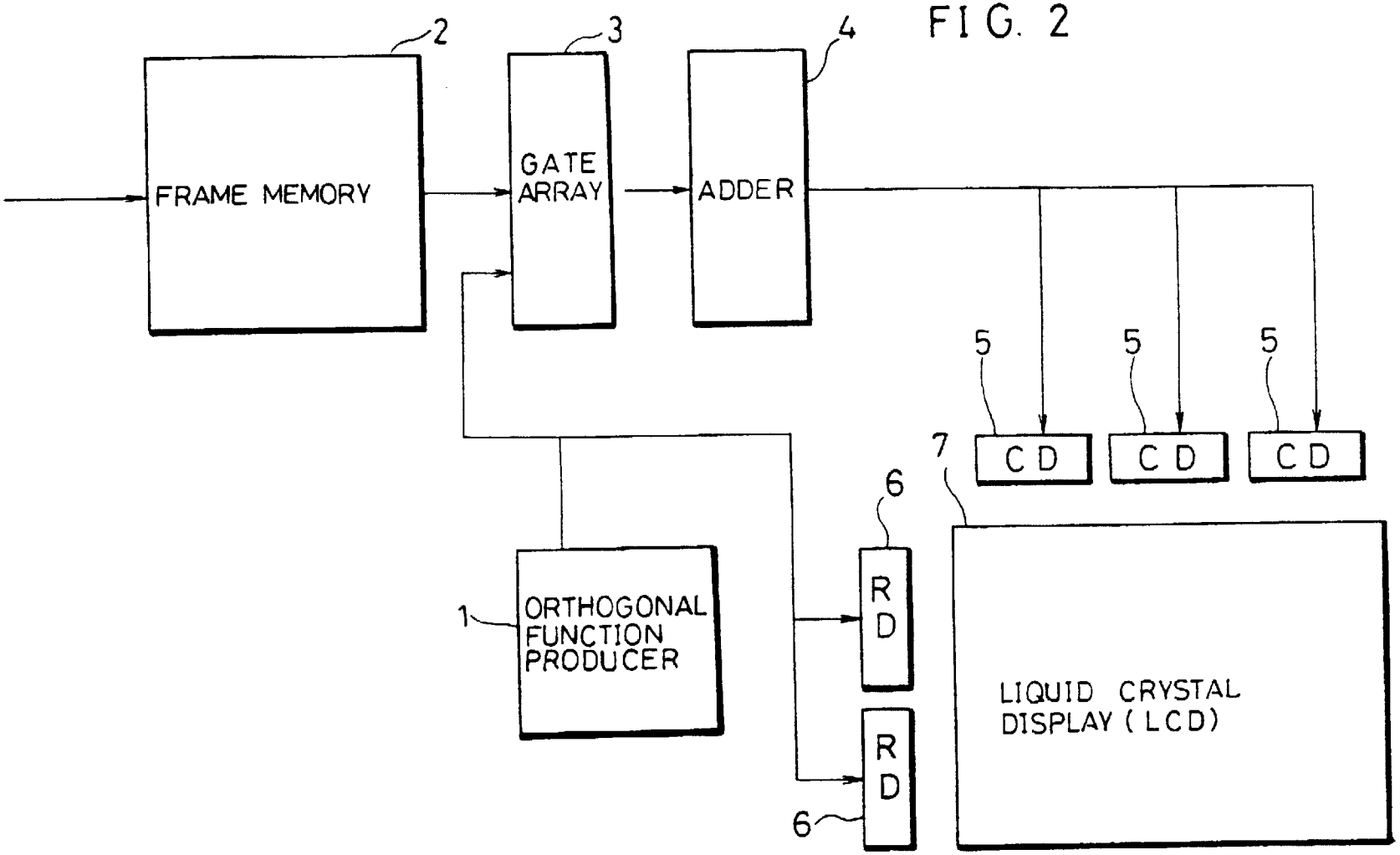
FIG. 2 is a block diagram showing the main structure of an LCD device which is commonly used for an LCD drive method in accordance with one embodiment of the present invention and for a conventional LCD drive method.

The driving method for a liquid crystal display (LCD) of one embodiment of the present invention is realized by the LCD device shown in FIG. 2. The LCD device is provided with an orthogonal function producer 1, a frame memory 2, a gate array 3, an adder 4, column drivers (recognized as CD in FIG. 2) 5, row drivers (recognized as RD in FIG. 2) 6, and an LCD 7. The LCD device is arranged such that the LCD 7 is driven by a simultaneous selection of 7 rows.

The orthogonal function producer 1 produces a row select signal in accordance with the row select voltage, using the orthogonal matrix (see Table 3). The level of the row select voltage is either +V or −V, and the row select signal is +1 (for logic "1") for +V and is 0 (for logic "0") for −V. Therefore, the orthogonal function producer 1 outputs +1 and 0 as the row select signal.

The frame memory 2 stores, for each frame, the display data of 7 rows selected simultaneously. In the display data, ON data corresponds to +1 (for logic "1") and OFF data corresponds to 0 (for logic "0").

Exclusive-OR operations are conducted by the gate array 3 with respect to corresponding elements between a display vector and a row select vector. The element of the row select vector is the row select signal outputted by the orthogonal function producer 1, while the element of the display vector is the display data read out from the frame memory 2. More concretely, the gate array 3 includes seven EX-OR gates 31 through 37 as shown in FIG. 1(*a*).

As shown in FIG. 1(*a*), elements $w_1$ through $w_6$ of the row select vector (see Table 3) are inputted to one input terminal of the respective EX-OR gates 31 through 36 of the gate array 3, and elements $d_1$ through $d_6$ of the display vector (see Table 5) are inputted to the other input terminal thereof. In the EX-OR gate 37, one input terminal has an input of the element $w_7$ of the row select vector and the other input terminal has an input of a virtual display data. The virtual display data indicates the display data to be applied to a virtual electrode assumed outside a display area of the LCD 7, and its data content can be arbitrarily selected.

The adder 4 is a circuit to conduct the summation of the output of the gate array 3. The output of the gate array 3 is the exclusive-OR of each corresponding elements between the elements $w_1$ through $w_7$ of the row select vector, and the elements $d_1$ through $d_6$ of the display vector and the virtual display data. In the adder 4, the number of mismatches of the exclusive-OR is counted. This adder 4 includes four operation units 41 through 44, called the slice adder circuit, as shown in FIG. 1(*a*).

Each of the operation units 41 through 44 has two EX-OR gates 401 and 402 and three NAND gates 403, 404, and 405 as shown in FIG. 1(*b*). Two input terminals of the respective EX-OR gate 401 and NAND gate 403 have inputs of signals supplied by the terminals A and B. Two input terminals of the respective EX-OR gate 402 and NAND gate 404 have inputs of the signal supplied by the terminal I and the output signal supplied by the EX-OR gate 401. The output signals supplied by the NAND gates 403 and 404 are inputted to the NAND gate 405. The output signal of the EX-OR gate 402 is supplied to the terminal S and the output signal of the NAND gate 405 is supplied to the terminal C.

To the terminals A, B, and I of the operation unit 41, the output signals of the EX-OR gates 32, 33, and 34 are inputted respectively. To the terminals A, B, and I of the operation unit 42, the output signals of the EX-OR gates 35, 36, and 37 are inputted respectively. To the terminals A, B, and I of the operation unit 43, the output signals of both the EX-OR gate 31 and the terminals S of the respective operation units 41 and 42 are inputted. To the terminals A, B, and I of the operation unit 44, the output signals of the terminals C of the operation units 41, 42, and 43 are respectively inputted.

The value $P_0$ is outputted from the terminal S of the operation unit 43. The values $P_1$ and $P_2$ are outputted from the terminals S and C of the operation unit 44 respectively. These values $P_0$, $P_1$, and $P_2$ of 3 bits correspond to the eight-stage voltage levels $V_0$ through $V_7$ shown in Table 4.

Each column driver 5 is a circuit to generate the column voltage to be applied to the column electrode of the LCD 7 in response to the output of the adder 4. Each row driver 6 is a circuit to generate the row select voltage to be applied to the row electrode of the LCD 7 in response to the output of the orthogonal function producer 1.

The LCD 7 has a plurality of row electrodes and column electrodes (not shown). The row electrodes are arranged so as to be parallel with each other, in the right and left direction of FIG. 2, whereas the column electrodes are provided so as to be intersected by the row electrodes and arranged so as to be parallel with each other in the up and down direction of FIG. 2. In addition, in this LCD 7, liquid crystal, responding to a root-mean-square (RMS) voltage, is filled up between the row electrodes and the column electrodes. The liquid crystal is driven by the application of a voltage to the row electrode and the column electrode.

In the LCD device with the above arrangement, the orthogonal function produced in the orthogonal function producer 1 is supplied not only to the gate array 3 but also to the row drivers 6. Exclusive-OR operations are conducted by the gate array 3 with respect to corresponding elements between the display vector and the row select vector. The element of the row select vector is the row select signal outputted from the orthogonal function producer 1, while the element of the display vector is the display data read out from the frame memory 2. The adder 4 conducts the summation of the respective outputs of the gate array 3. The outputs of the adder 4 are the values $P_0$, $P_1$, and $P_2$ which correspond to the above-mentioned voltage levels $V_0$ through $V_7$.

The column drivers 5 output the column voltages each having the level in response to the output of the adder 4. On the other hand, the row drivers 6 output the row select voltages in response to the output of the orthogonal function producer 1. The row select voltages are successively outputted in synchronization with the output of the column voltages. In this way, the liquid crystal of selected pixels is driven in the LCD 7, so that the display is made according to the display data.

Here, the virtual display data, whose content can be optionally selected, is supplied to the EX-OR gate 37 in the gate array 3. This virtual display data is for a virtual row assumed outside the display area. The ON data is selected as such virtual display data in the case where the data of the display area, supplied to the EX-OR gates 31 through 36 and selected simultaneously, are all ON data. The OFF data is selected as the virtual display data in the case where the data of the display area are all OFF data.

Figure 9:
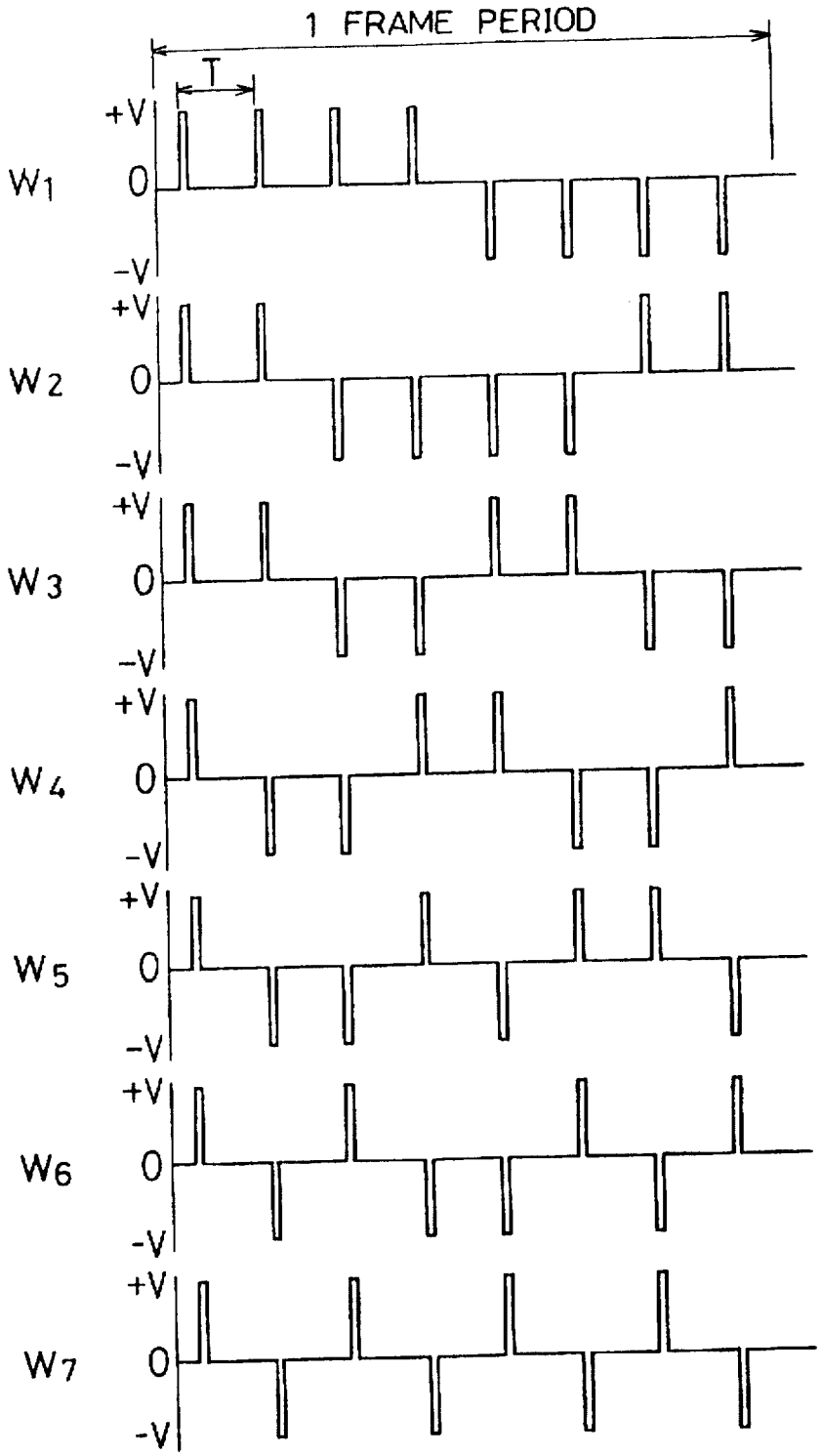
FIG. 9 is a waveform chart showing the waveform of the row select voltage to be applied to each of row electrodes in the case where plural row electrodes are simultaneously selected.
Figure 10:
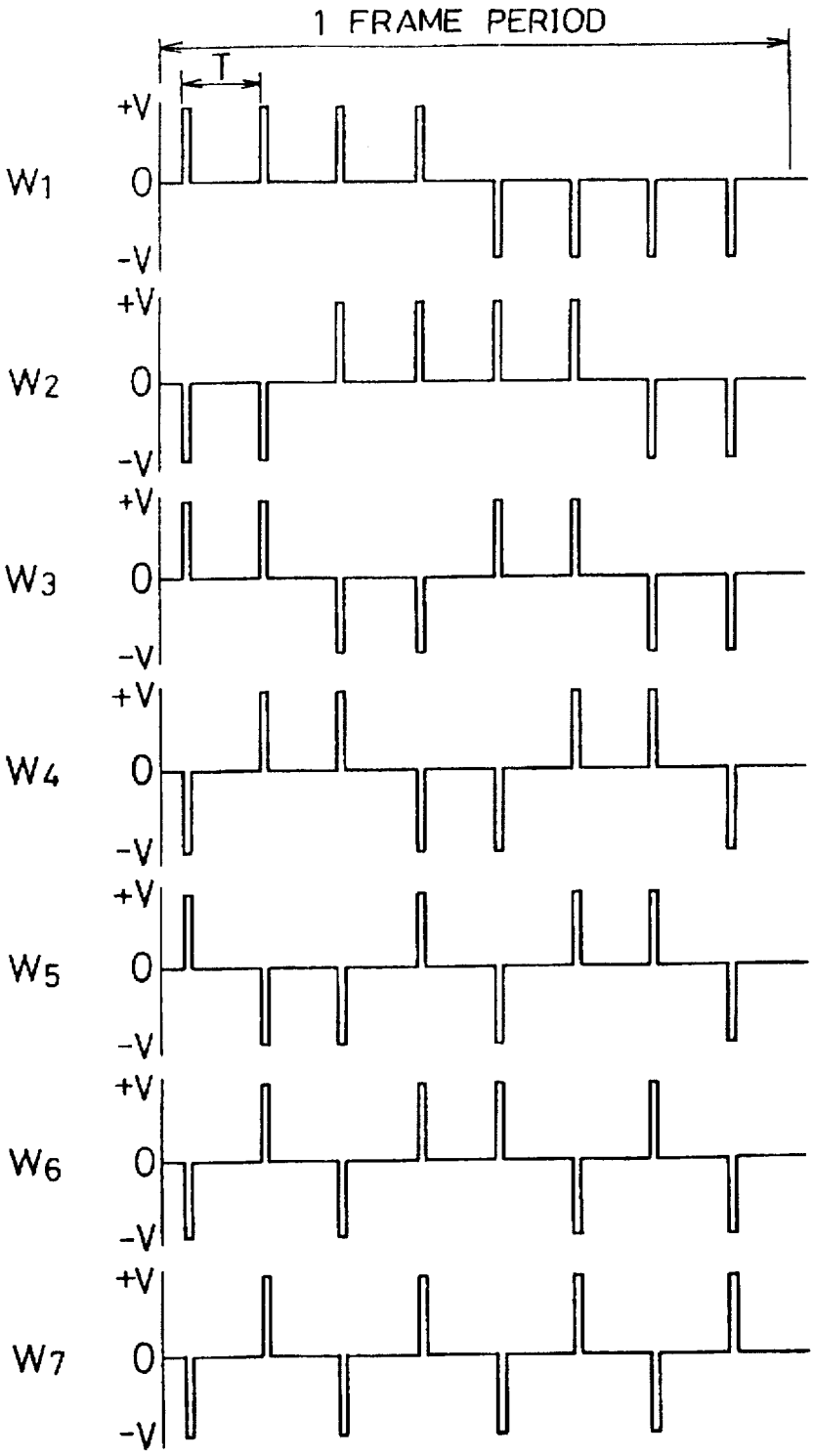
FIG. 10 is a waveform chart showing another waveform of the row select voltage to be applied to each of row electrodes in the case where a plurality of row electrodes are simultaneously selected.
Figure 11:
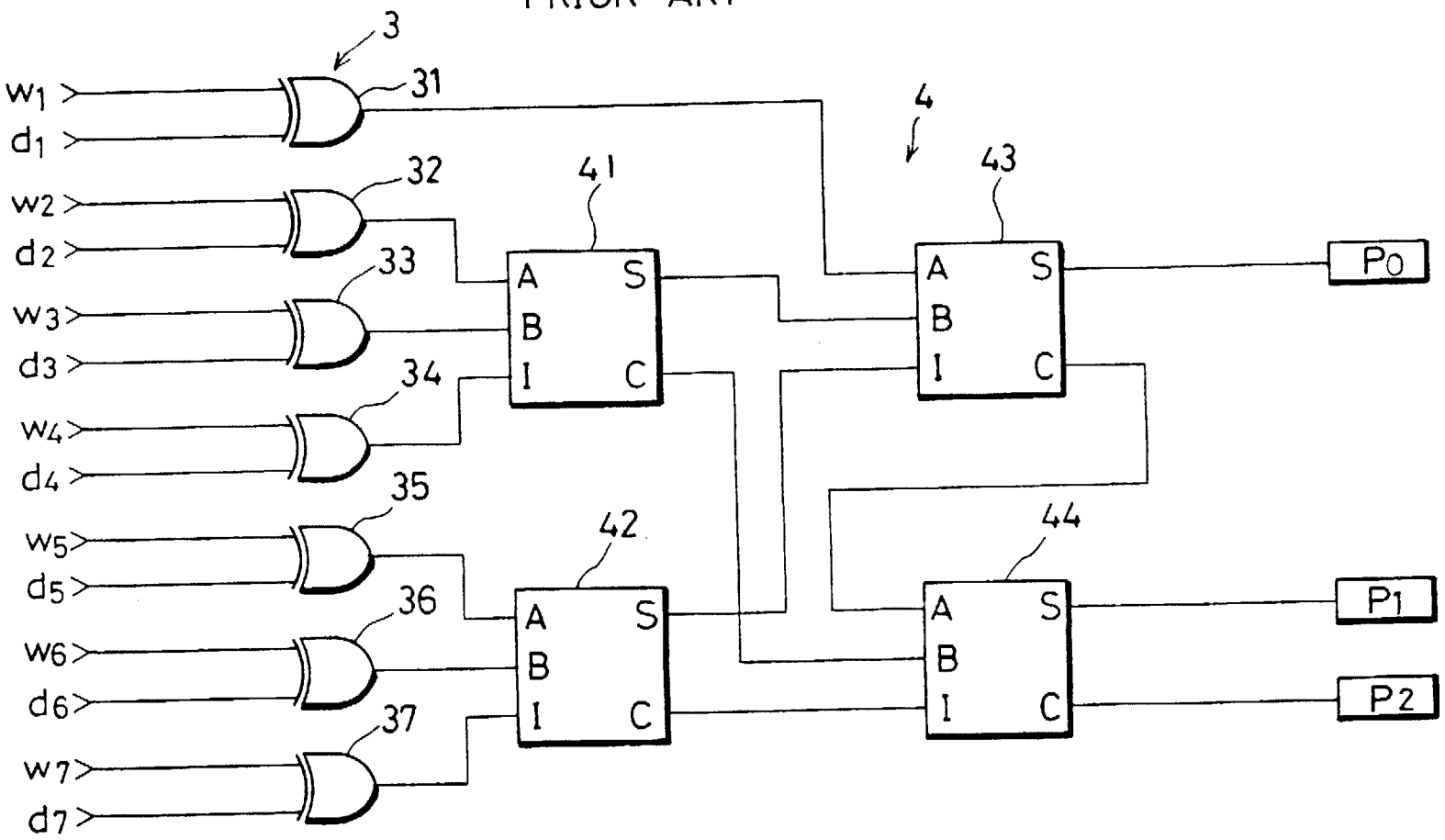
FIG. 11 PRIOR ART
FIG. 11 is a block diagram showing the structure of both a gate array and an adder in the LCD device for realizing the conventional LCD drive method.
Figure 12:
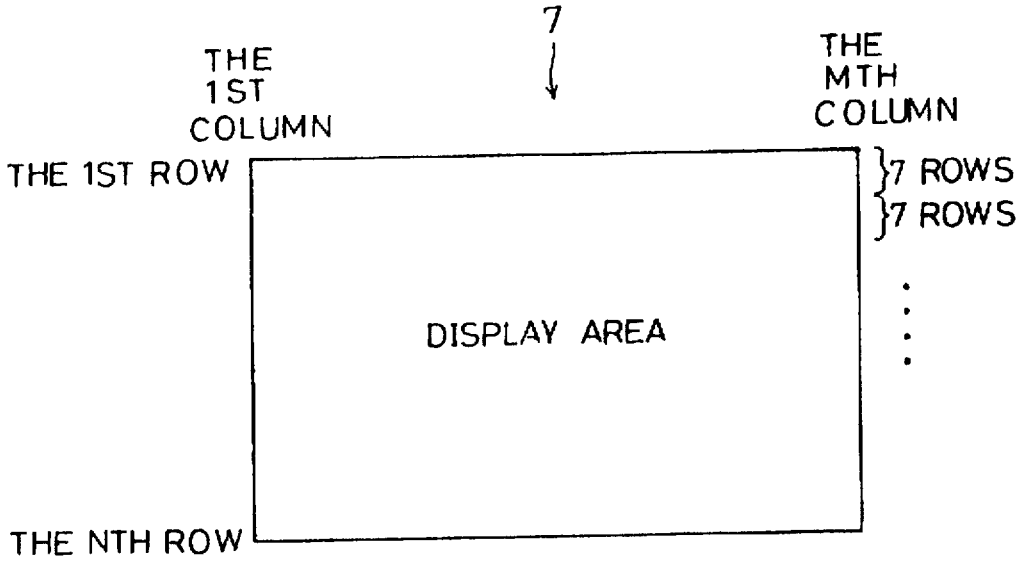
FIG. 12 PRIOR ART
FIG. 12 is an explanatory diagram showing the correlation between the display area and the selected rows in the case where 7 rows are selected simultaneously in the conventional LCD drive method.
Figure 13:
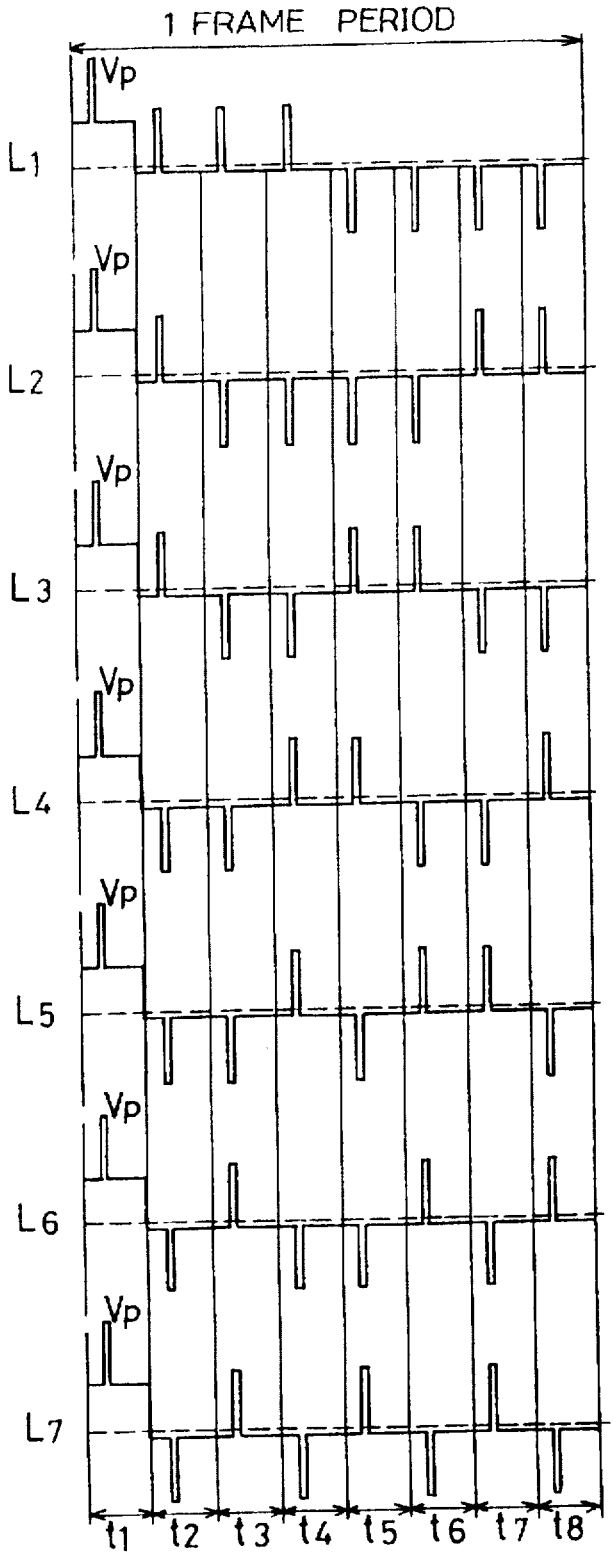
FIG. 13 is a waveform chart showing the waveform of the driving voltage for ON display over the whole pixels corresponding to the row select voltage of FIG. 9.
Figure 14:
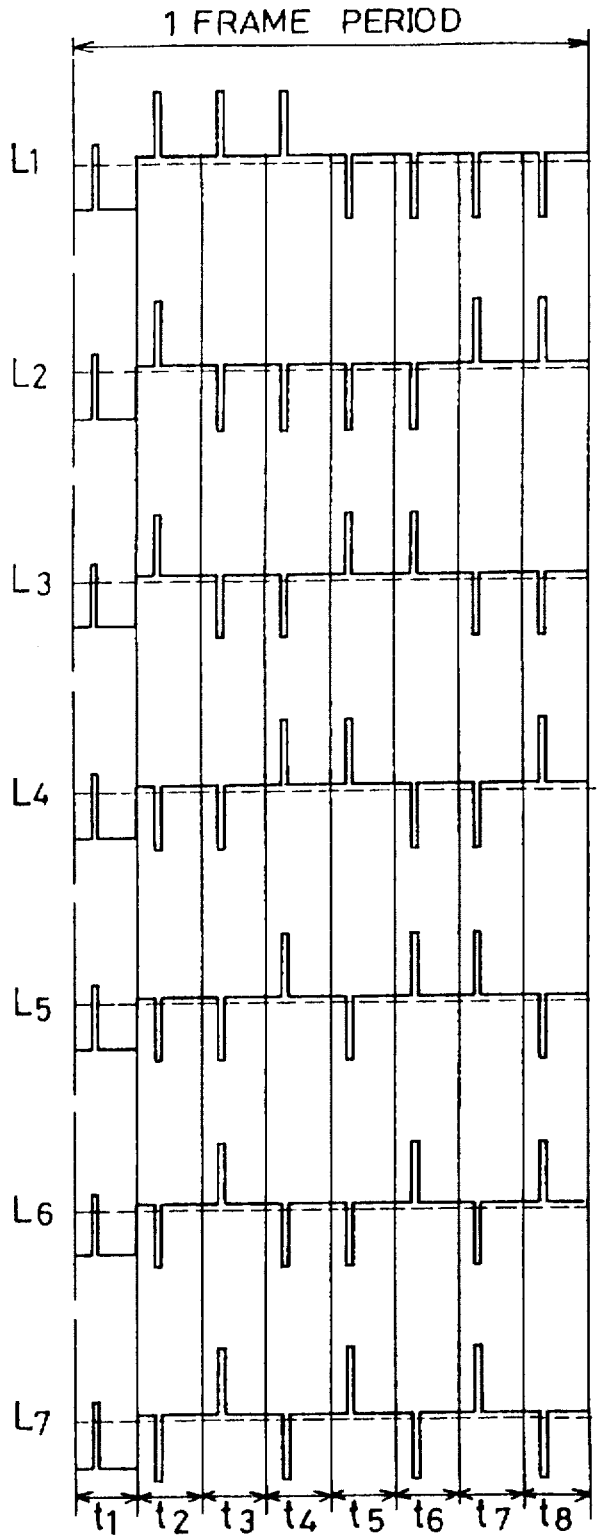
FIG. 14 is a waveform chart showing the waveform of the driving voltage for OFF display over the whole pixels corresponding to the row select voltage of FIG. 9.

Such data selection of the virtual display data causes that all matches or all mismatches of the output of the gate array 3 never occur in the case of reversing the polarity of plural rows of the orthogonal matrix, thereby resulting in that no frame response phenomenon occurs (see FIG. 9).

Figure 3:
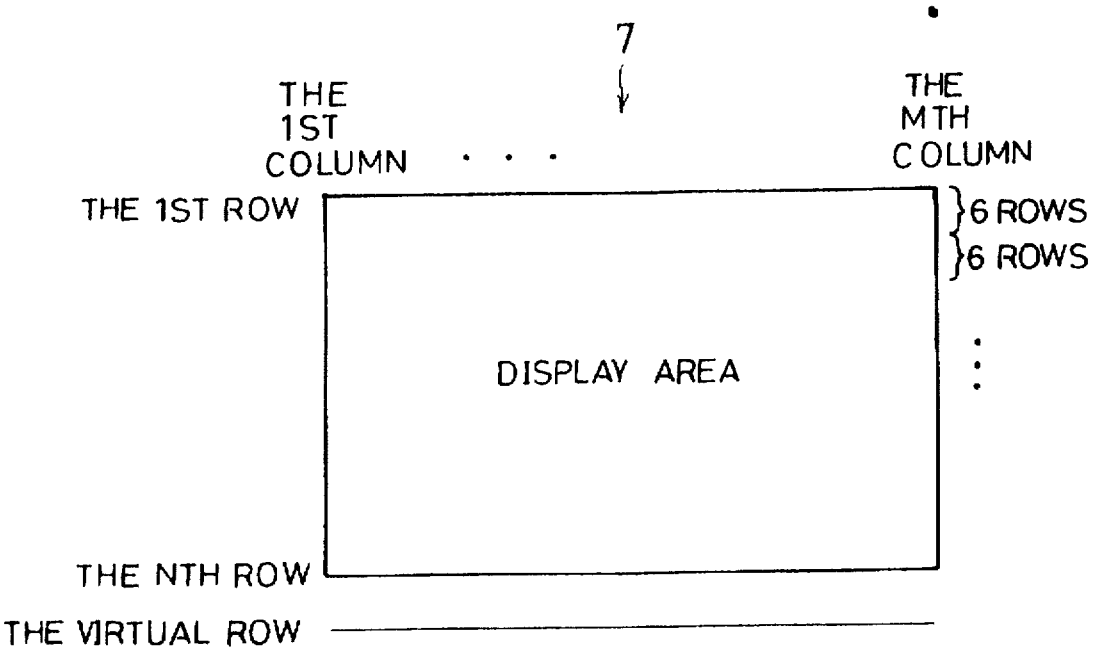
FIG. 3(*a*) is an explanatory diagram showing the correlation between the display area and the selected rows in the case where 7 rows are simultaneously selected in the present LCD drive method.
Figure 3:
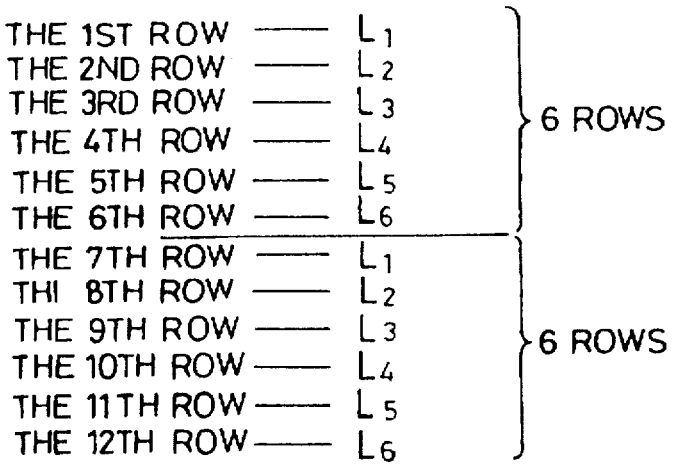

Even though there is one selected row $L_7$ having an unique value of select voltage among 7 rows selected simultaneously in the case of ON display or OFF display over the whole pixels, the selected row $L_7$ among the selected rows $L_1$ through $L_7$ is assigned to the virtual row assumed outside the display area of the LCD 7 in this LCD drive method, as shown in FIGS. 3(*a*) and 3(*b*). In this drive method, the data for the 6 rows to be really driven (displayed) are supplied to the selected rows $L_1$ through $L_6$ respectively and the virtual display data not to be displayed is supplied to the selected row $L_7$.

Figure 4:
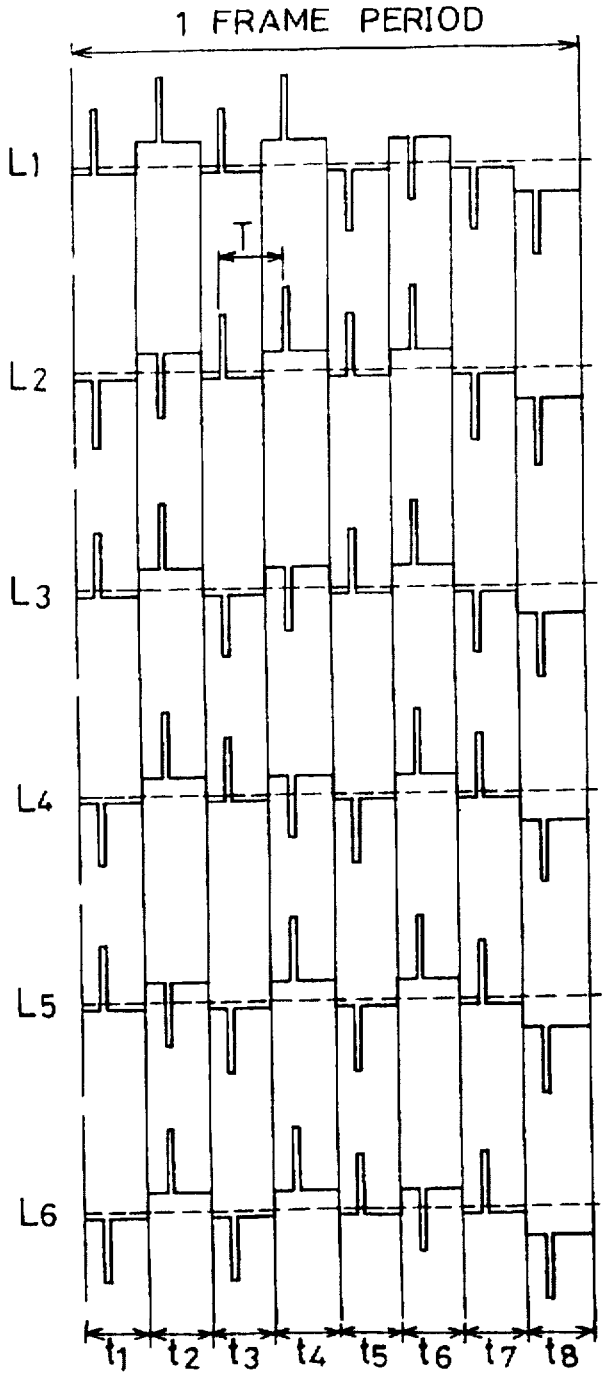
FIG. 4 is a waveform chart showing the waveforms of the driving voltage for ON display over the whole pixels in the case where 7 rows are simultaneously selected in the present LCD drive method.
Figure 5:
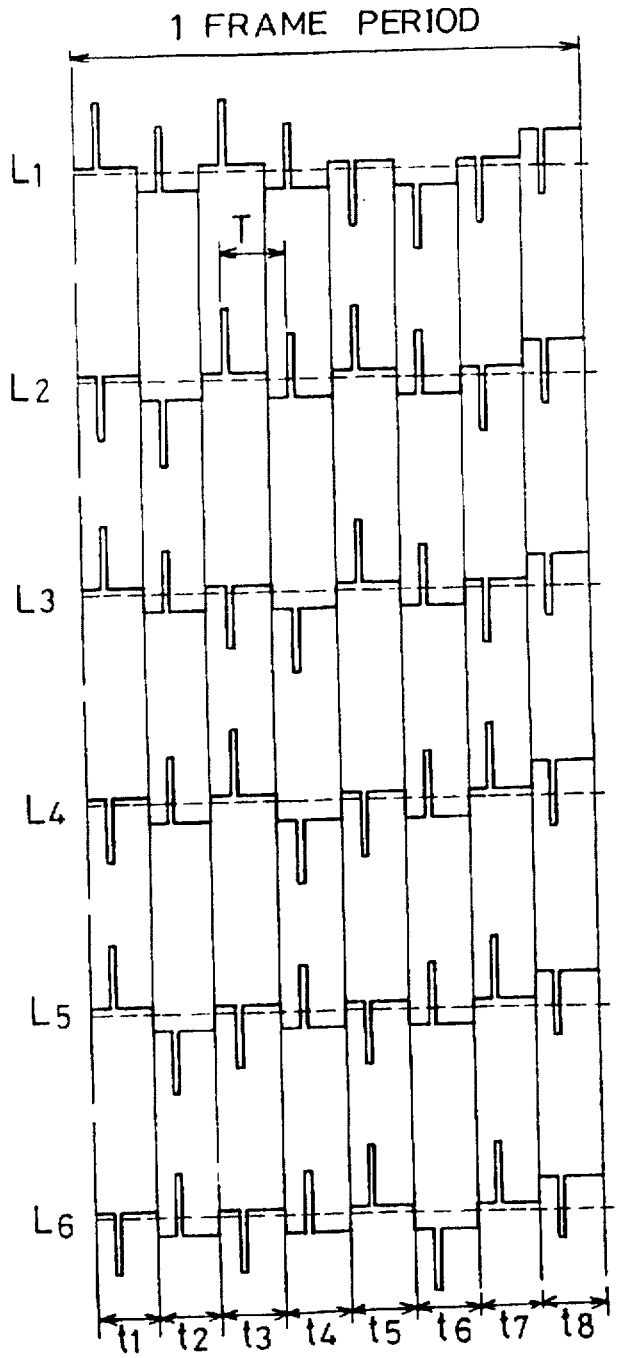
FIG. 5 is a waveform chart showing the waveforms of the driving voltage for OFF display over the whole pixels in the case where 7 rows are simultaneously selected in the present LCD drive method.
Figure 15:
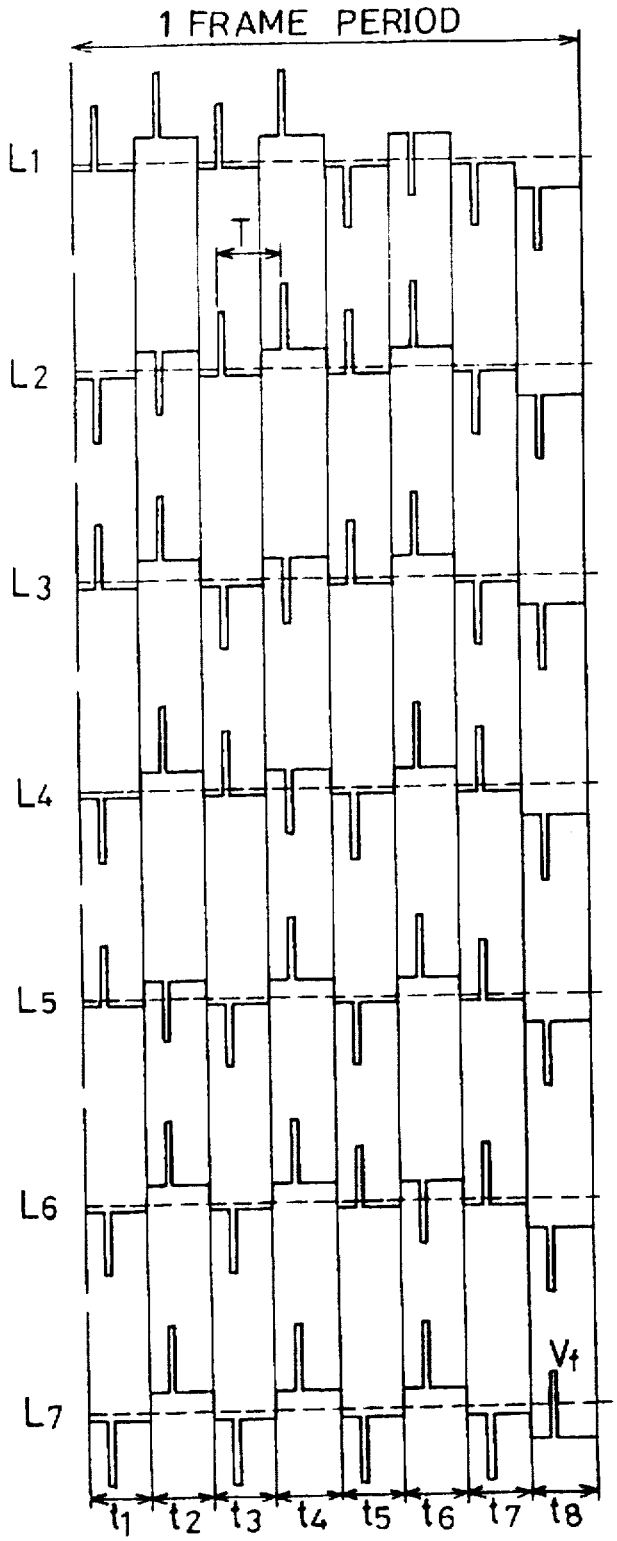
FIG. 15 is a waveform chart showing the waveform of the driving voltage for ON display over the whole pixels corresponding to the row select voltage of FIG. 10.
Figure 16:
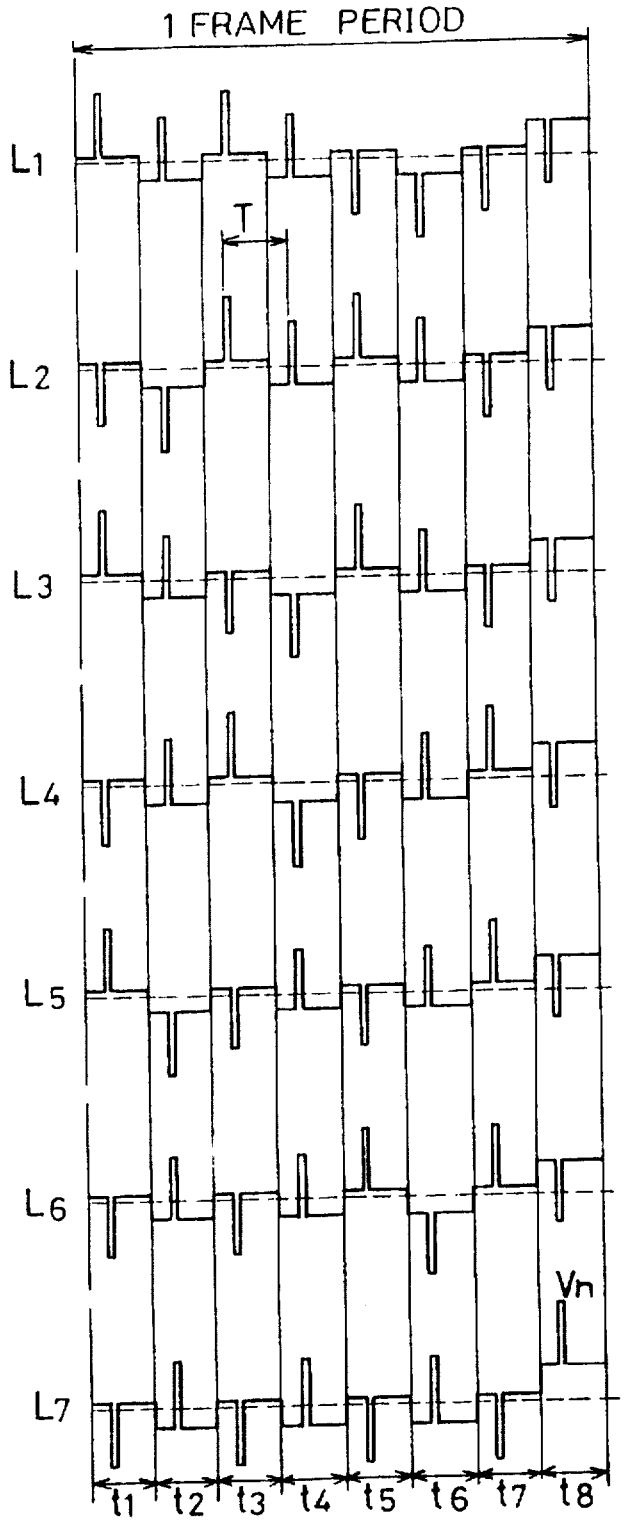
FIG. 16 is a waveform chart showing the waveform of the driving voltage for OFF display over the whole pixels corresponding to the row select voltage of FIG. 10.
Figure 17:
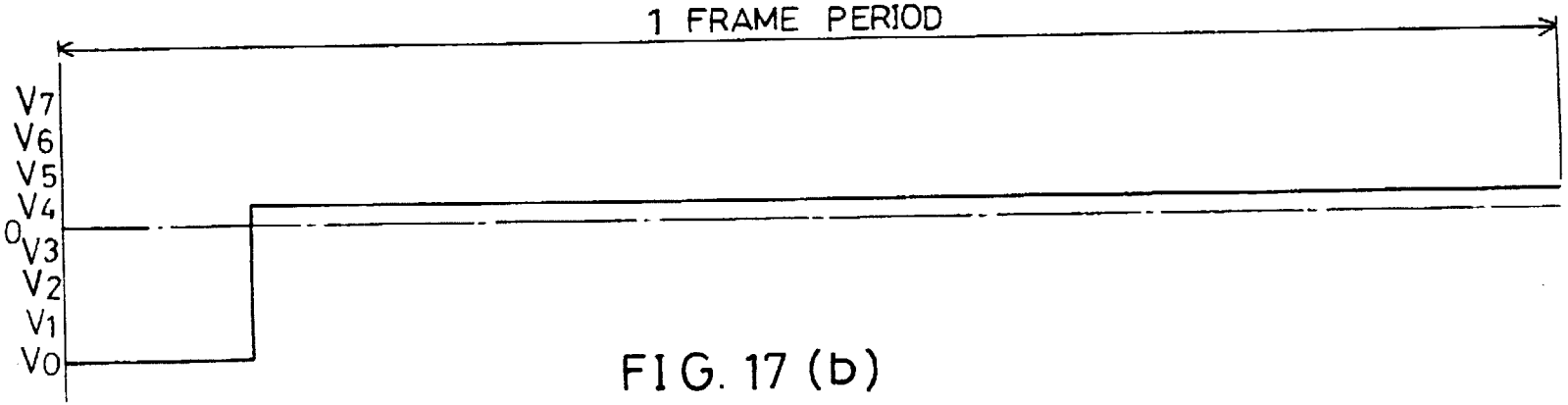
FIG. 17(*a*) is a waveform chart showing the waveform of the column voltage for ON display over the whole pixels corresponding to the row select voltage of FIG. 9.
Figure 17:
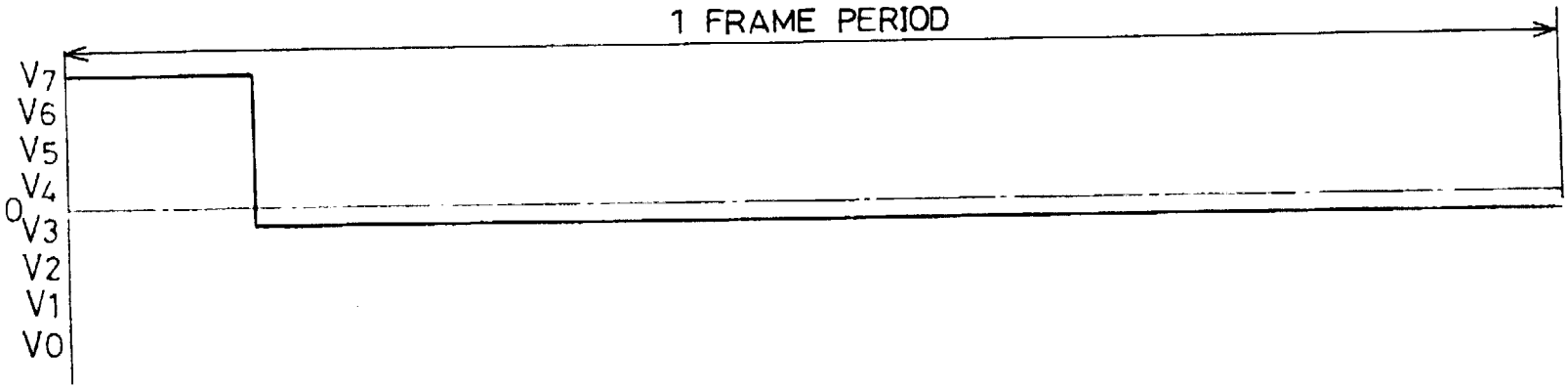
Figure 18:
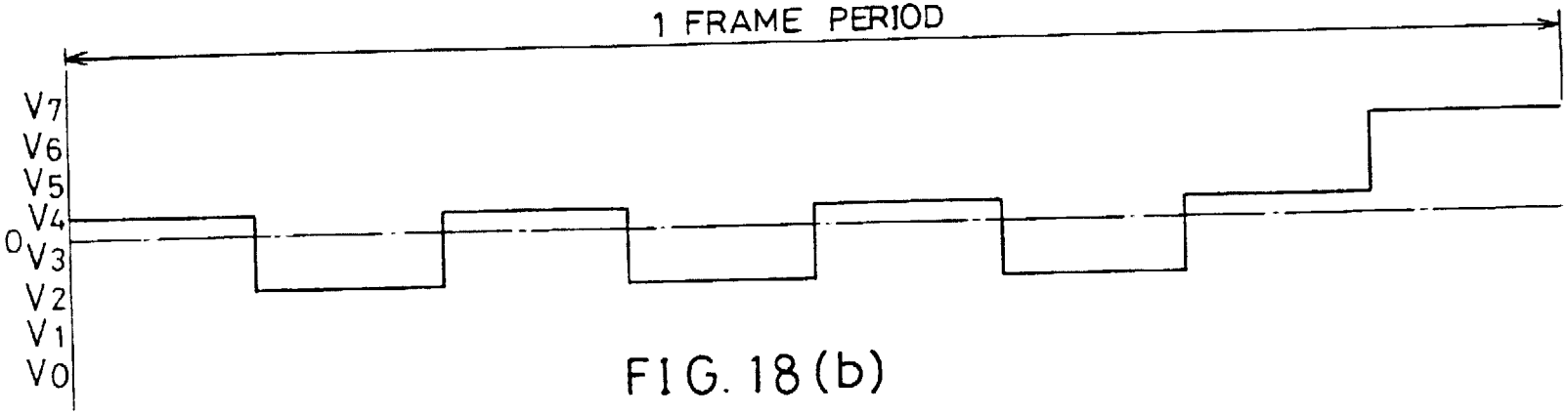
FIG. 18(*a*) is a waveform chart showing the waveform of the column voltage for ON display over the whole pixels corresponding to the row select voltage of FIG. 10.
Figure 18:
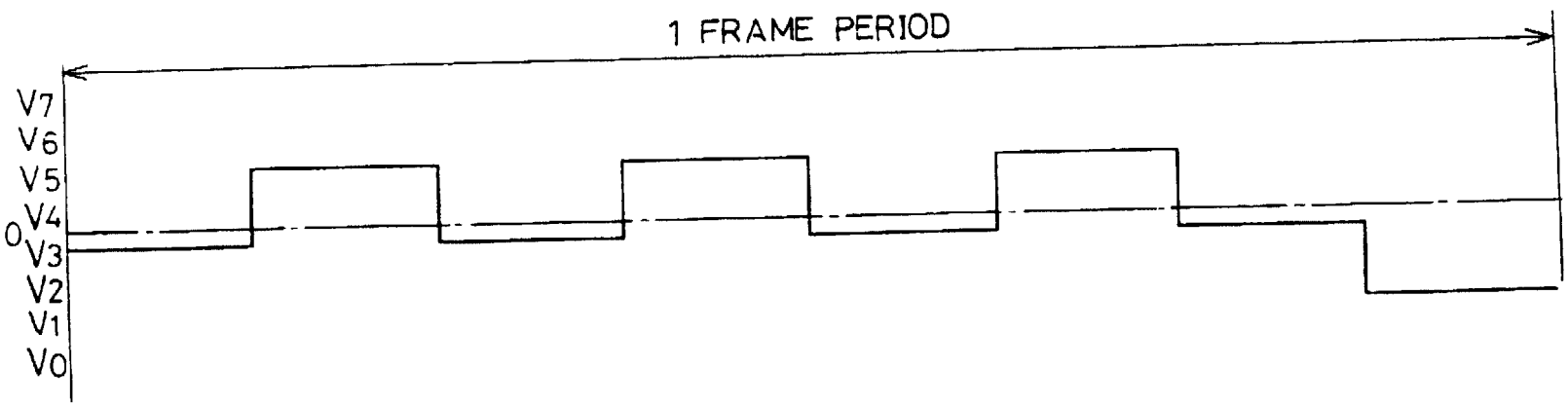
Figure 19:
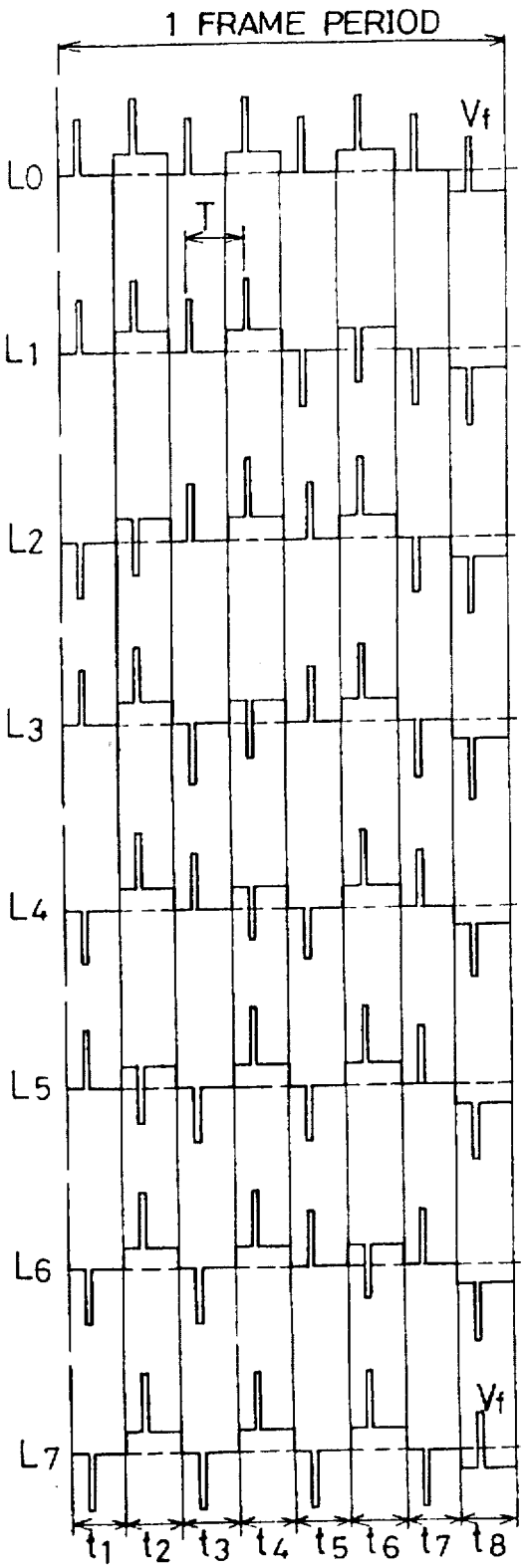
FIG. 19(*a*) is a waveform chart showing the waveform of the driving voltage for ON display over the whole pixels in the case where there is the unique voltage in each of two rows.
Figure 19:
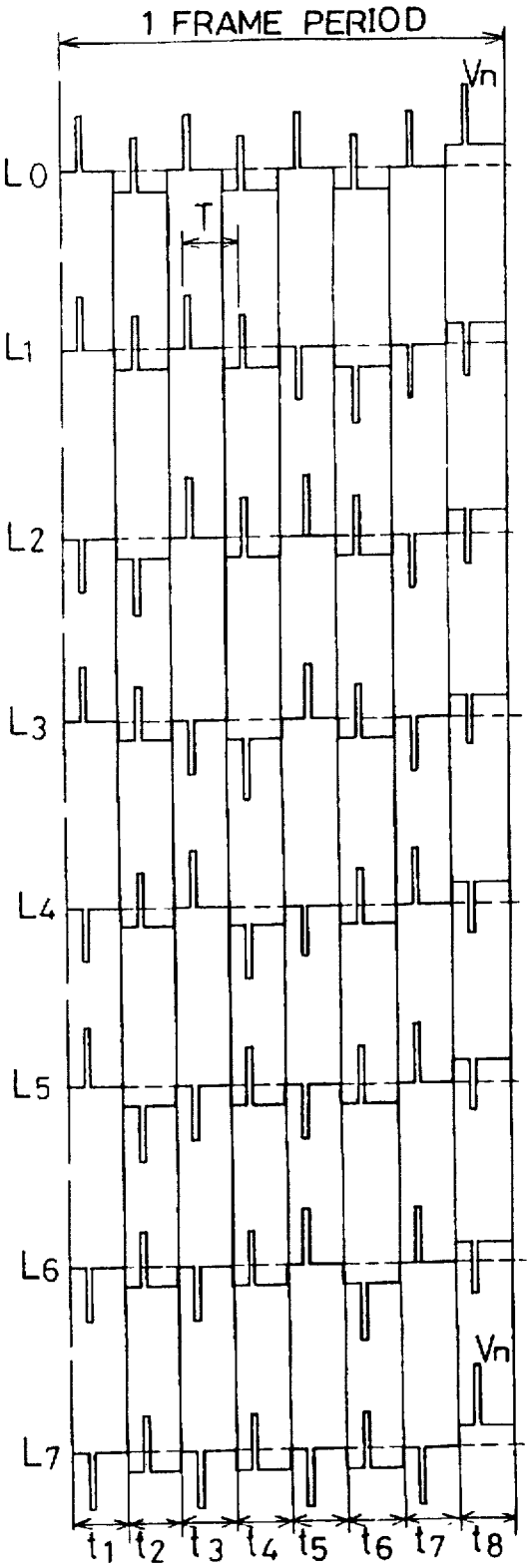
Figure 20:
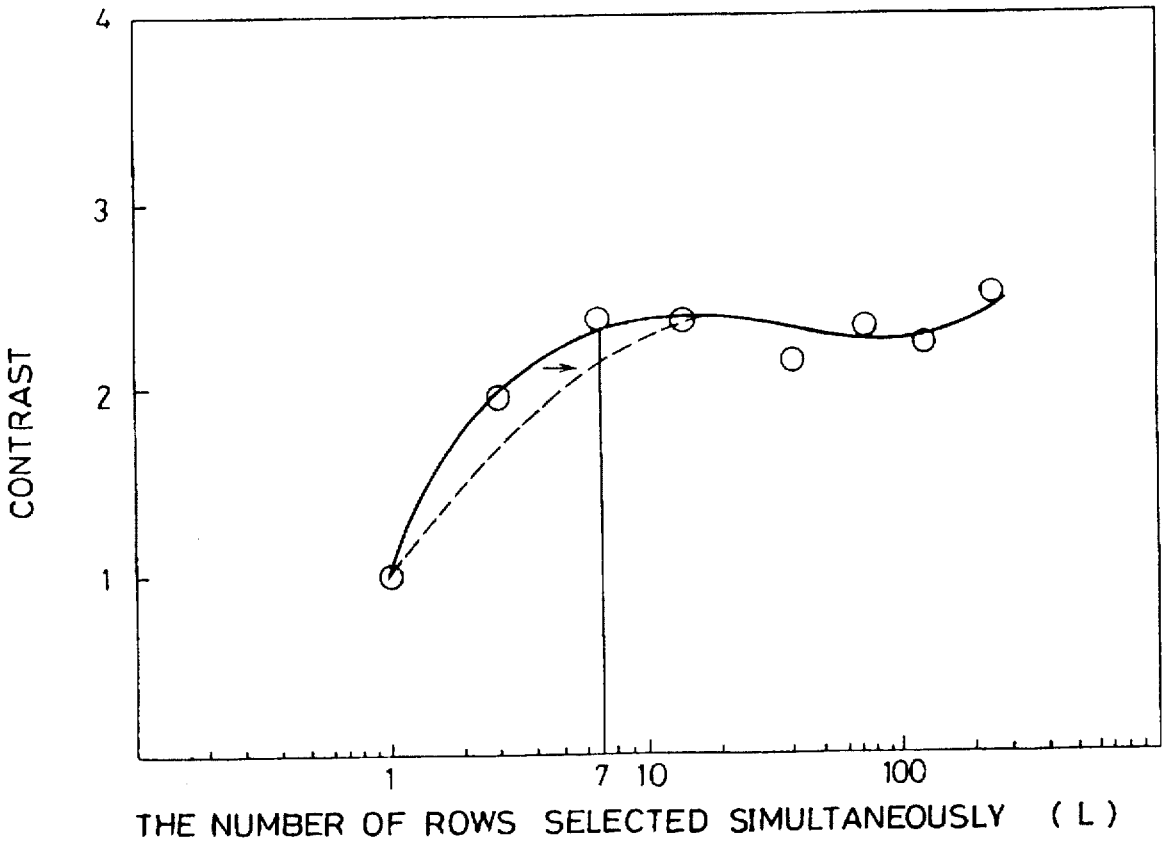
FIG. 20 is a graph showing the correlation between the contrast and the number of rows selected simultaneously.

The driving voltage waveforms obtained by this LCD drive method are shown in FIGS. 4 and 5. FIG. 4 shows the driving voltage waveform in the case of ON display over the whole pixels and FIG. 5 shows the driving voltage waveform in the case of the OFF display over the whole pixels. In the driving voltage waveforms, the selected row $L_7$ having the unique voltage is excluded (see FIGS. 15 and 16). Therefore, this LCD drive method can shift the contrast stripe, due to the unique voltage, outside the display area and can prevent the occurrence of the contrast stripe within the display area, thereby achieving improved even display with high quality.

In the foregoing described driving method, 7 rows are simultaneously selected so as to make a display. However, the driving method for an LCD of the present invention can also be adopted in the case where the number of rows selected simultaneously is other than 7 rows, for example, in the case where the number of rows selected simultaneously is 15 rows. The following description deals with an LCD drive in which 15 rows are simultaneously selected, in accordance with another embodiment of the present invention.

Figure 6:
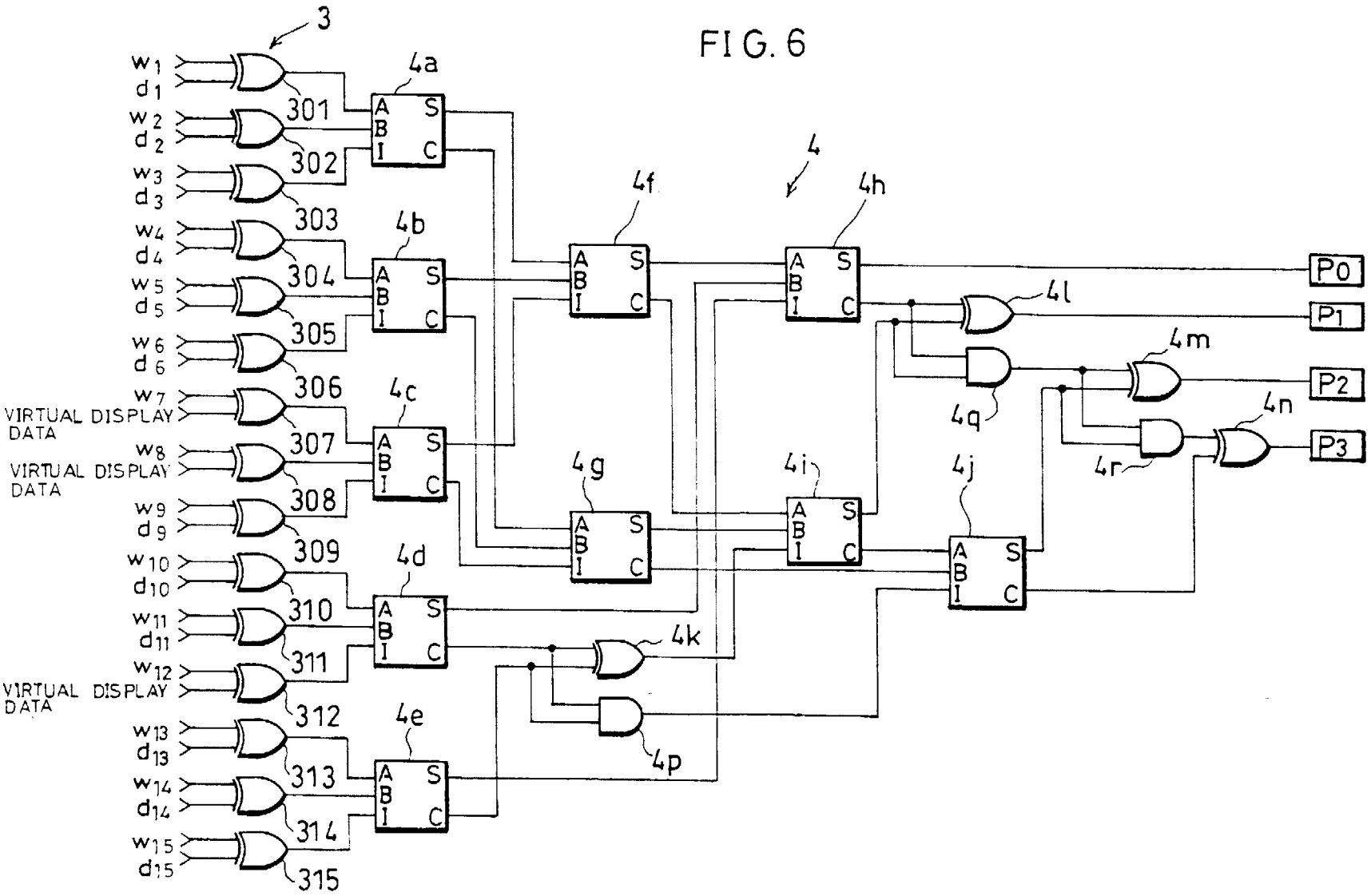
FIG. 6 is a block diagram showing the structure of both a gate array and an adder in an LCD device for realizing the LCD drive method in which 15 rows are simultaneously selected, in accordance with another embodiment of the present invention.
Figure 7:
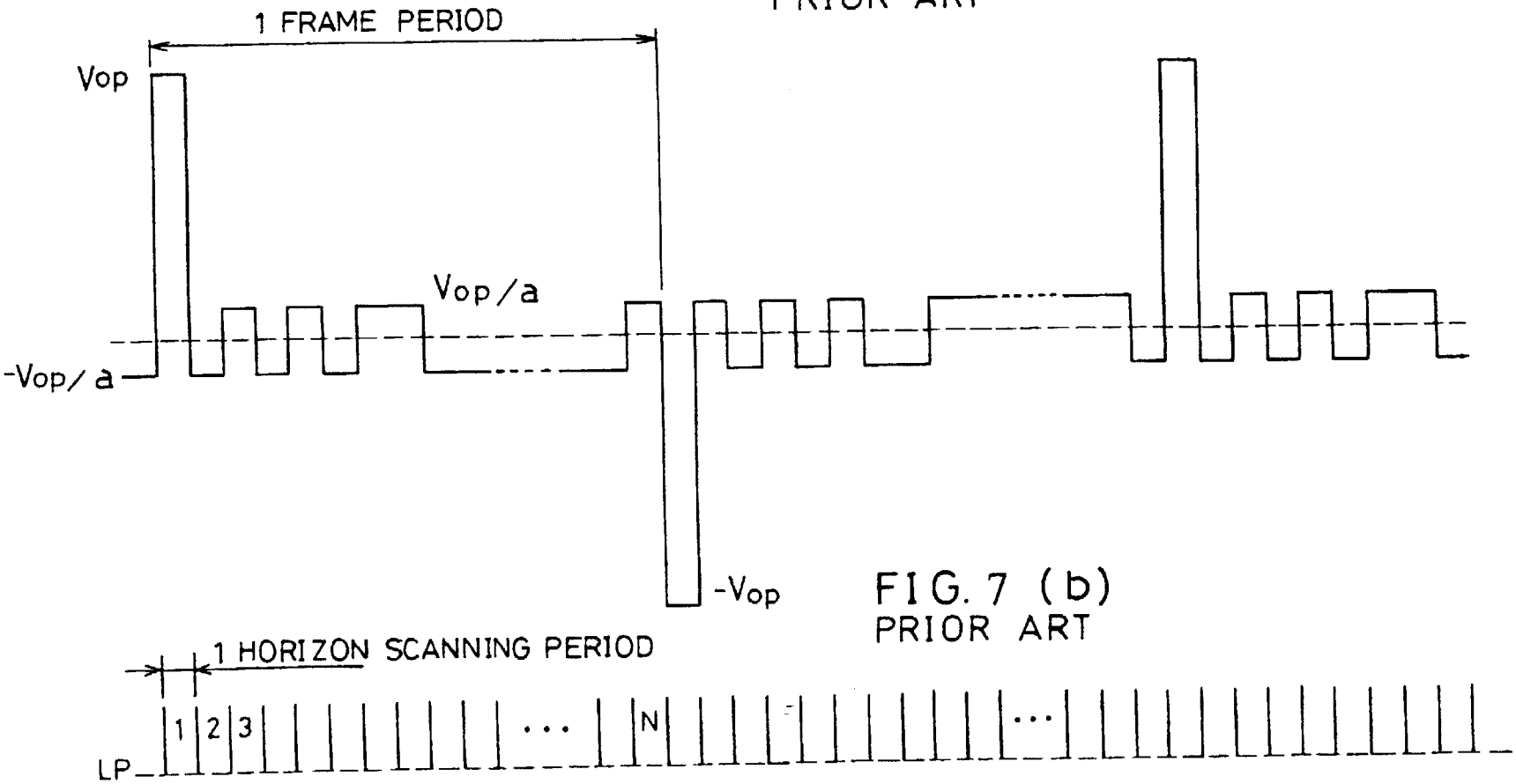
FIG. 7 (a) PRIOR ART
FIG. 7 (b) PRIOR ART
FIG. 7(*a*) is a waveform chart showing the waveforms of the driving voltage for ON display in the conventional LCD.
Figures 8A, 8B:
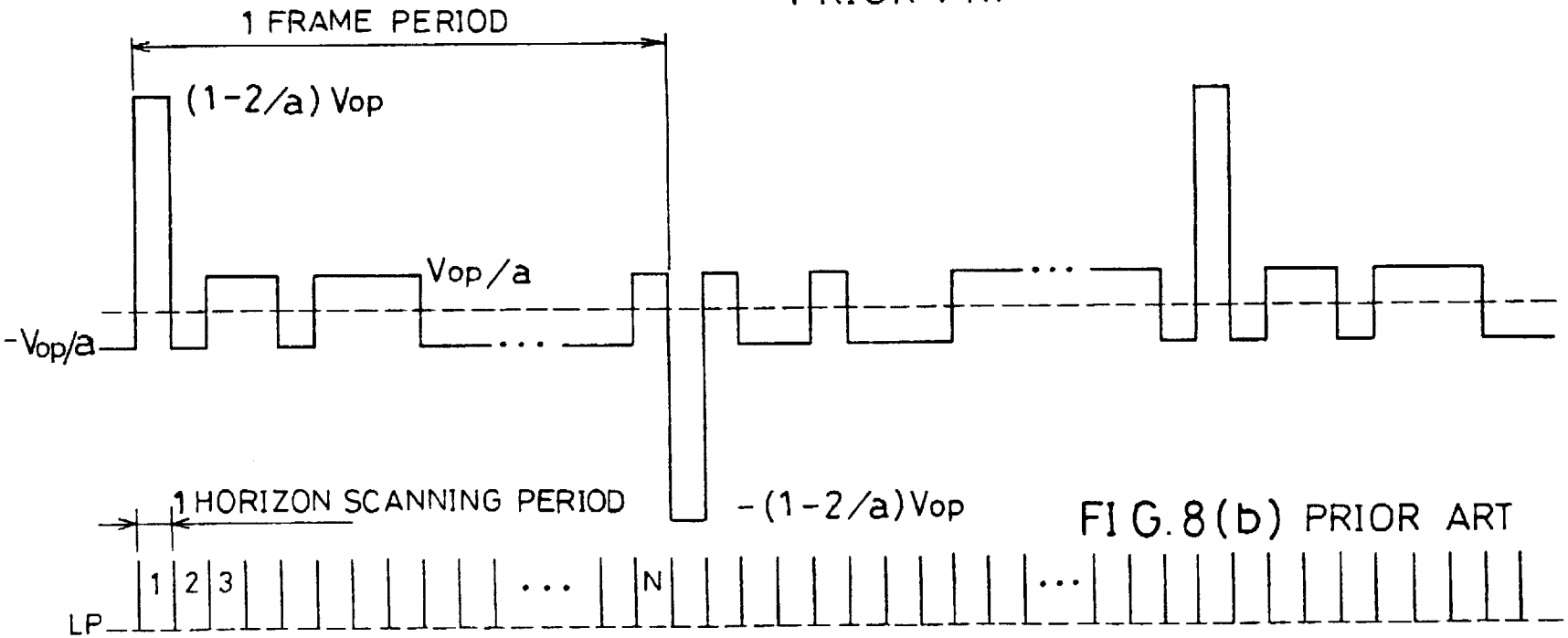
FIG. 8(a) PRIOR ART
FIG. 8(b) PRIOR ART
FIG. 8(*a*) is a waveform chart showing the waveform of the driving voltage for OFF display in the conventional LCD.

In this LCD drive in which 15 rows are simultaneously selected, a gate array 3 is provided with fifteen EX-OR gates 301 through 315, as shown in FIG. 6.

Elements $w_1$ through $w_6$ of the row select vector (see Table 7) are inputted to one input terminal of the respective EX-OR gates 301 through 306 of the gate array 3, and elements $d_1$ through $d_6$ of the display vector are inputted to the other input terminal thereof. Elements $w_9$ through $w_{11}$ of the row select vector are inputted to one input terminal of the respective EX-OR gates 309 through 311, and elements $d_9$ through $d_{11}$ of the display vector are inputted to the other input terminal thereof. Elements $w_{13}$ through $w_{15}$ of the row select vector are inputted to one input terminal of the respective EX-OR gates 313 through 315, and elements $d_{13}$ through $d_{15}$ of the display vector are inputted to the other input terminal thereof.

Moreover, elements $w_7$, $w_8$, and $w_{12}$ of the row select vector are inputted to one input terminal of the respective EX-OR gates 307, 308, and 312, and virtual display data are inputted to the other input terminal thereof. Exclusive-OR operation is conducted by the respective EX-OR gates 301 through 315 with respect to corresponding elements.

An adder 4 is a circuit to conduct the summation of the outputs of the gate array 3, and the number of mismatches of the respective exclusive-OR operations is counted by the adder 4. In this LCD drive in which 15 rows are simultaneously selected, the adder 4 is provided with ten one-bit-full-adders 4*a* through 4*j*, four EX-OR gates 4*k* through 4*n*, and three AND gates 4*p* through 4*r*, as shown in FIG. 6. This adder 4 is called the slice adder circuit.

To the terminals A, B, and I of the one-bit-full-adder 4*a*, the output signals supplied by the EX-OR gates 301, 302, and 303 are inputted respectively. Concretely, the output signal corresponds to "0" signal when a match occurs between corresponding elements in the respective EX-OR gates 301, 302, and 303. In contrast, the output signal corresponds to "1" signal when a mismatch occurs between corresponding elements in the respective EX-OR gates 301, 302, and 303. The one-bit-full-adder 4*a* counts the number of mismatches (i.e., the number of "1") of the exclusive-OR operations by the EX-OR gates 301, 302, and 303.

In the same manner, the one-bit-full-adder 4*b* counts the number of mismatches of the exclusive-OR operations by the EX-OR gates 304, 305, and 306. The one-bit-full-adder 4*c* counts the number of mismatches of the exclusive-OR operations by the EX-OR gates 307, 308, and 309. The one-bit-full-adder 4*d* counts the number of mismatches of the exclusive-OR operations by the EX-OR gates 310, 311, and 312. The one-bit-full-adder 4*e* counts the number of mismatches of the exclusive-OR operations by the EX-OR gates 313, 314, and 315.

Following the counts by the one-bit-full-adders 4*a* through 4*e*, the adder 4 still conducts the summation of the outputs of the gate array 3, and the adder 4 outputs four values of $P_0$ through $P_3$. These four values $P_0$ through $P_3$ correspond to sixteen-stage voltage levels for generating the column voltage. The column drivers output the column voltages in response to the four values of $P_0$ through $P_3$, whereas the row drivers output the row select voltages in response to the row signals in synchronization with the output of the column voltages by the column drivers.

Figure 21:
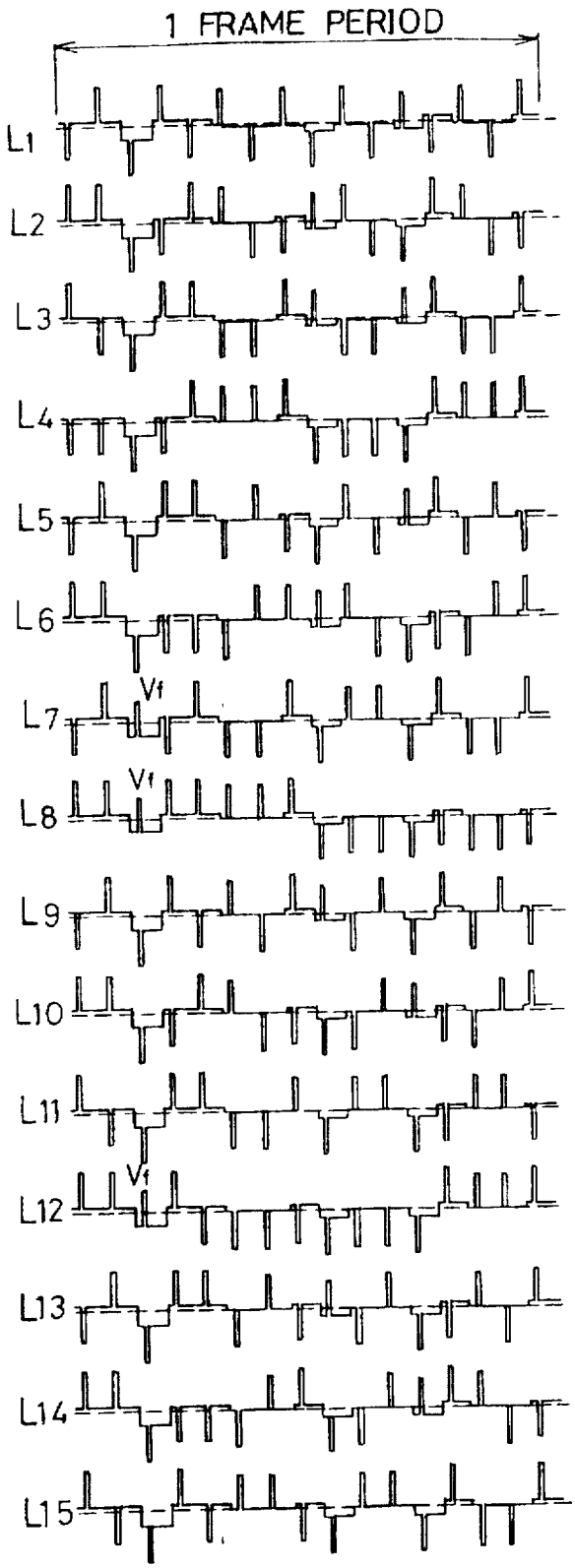
FIG. 21(*a*) is a waveform chart showing the waveform of the driving voltage for ON display over the whole pixels in the case where 15 rows are simultaneously selected.
Figure 21:
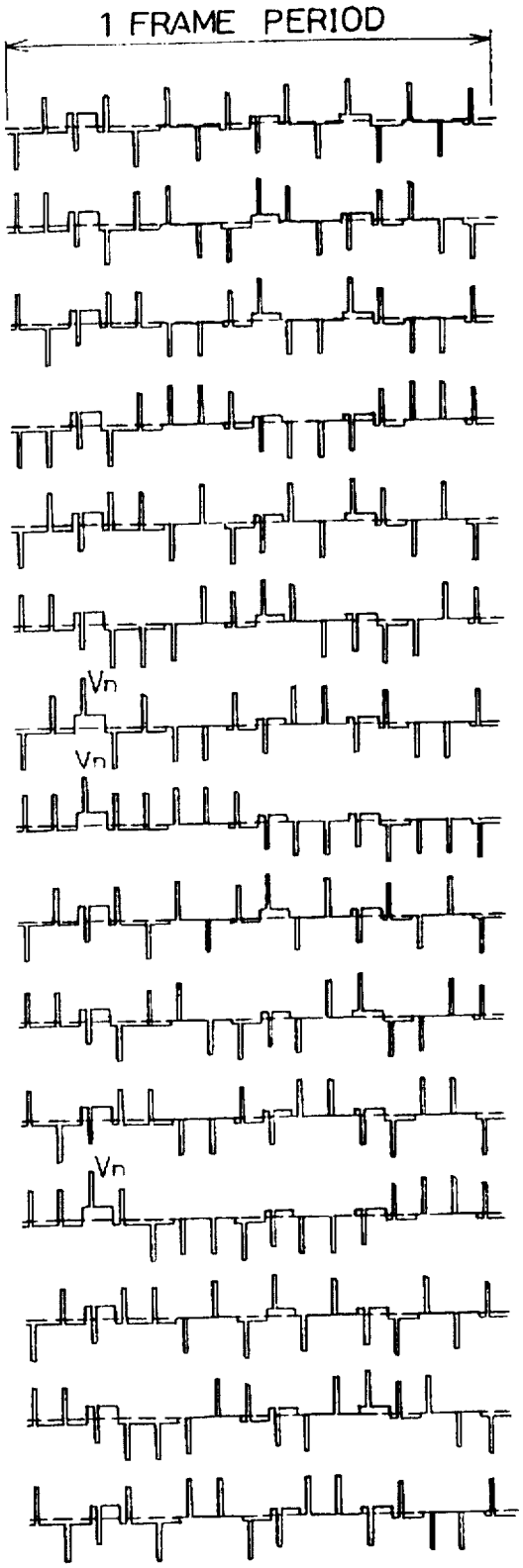
Figure 22:
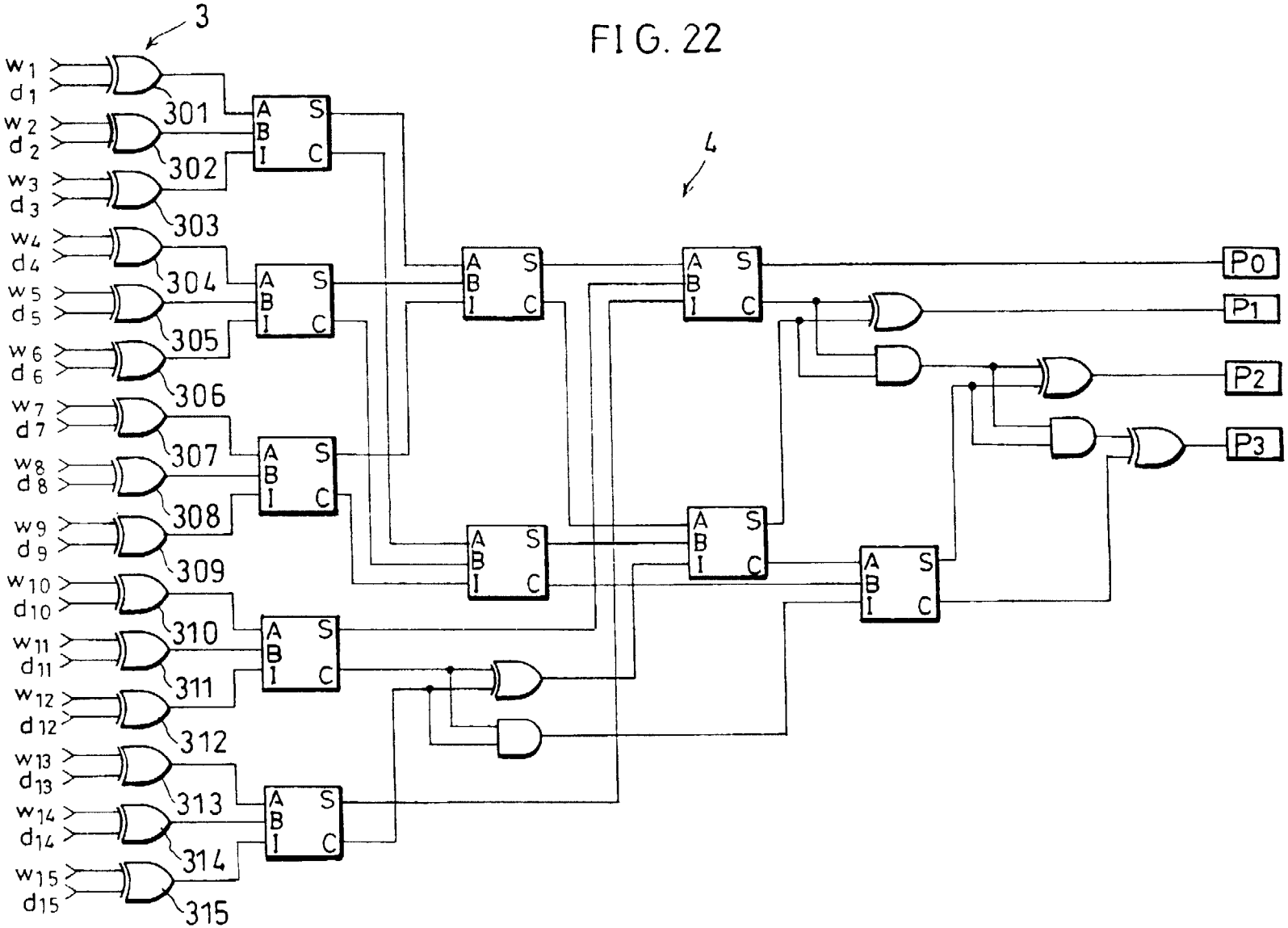
FIG. 22 is a block diagram showing the structure of both a gate array and an adder in an LCD device for realizing the conventional LCD drive method in which 15 rows are simultaneously selected.

In the conventional LCD drive method in which 15 rows $L_1$ through $L_{15}$ are selected simultaneously, there are three selected rows $L_7$, $L_8$, and $L_{12}$ each having a unique value of select voltage among 15 rows $L_1$ through $L_{15}$ in the case of ON display or OFF display over the whole pixels (see FIGS. 21(*a*) and 21(*b*)). In this LCD drive method, however, the three selected rows $L_7$, $L_8$, and $L_{12}$ among the selected rows $L_1$ through $L_{15}$ are assigned to a plurality of virtual rows assumed outside the display area of the LCD. In addition, the data $d_1$ through $d_6$, $d_9$ through $d_{11}$, and $d_{13}$ through $d_{15}$ for the 12 rows to be really driven (displayed) are supplied to the selected rows $L_1$ through $L_6$, $L_9$ through $L_{11}$, and $L_{13}$ through $L_{15}$ respectively and the virtual display data not to be displayed is supplied to the three selected rows $L_7$, $L_8$, and $L_{12}$.

In the driving voltage waveforms obtained by this LCD drive method, the driving voltage waveforms of the three selected rows $L_7$, $L_8$, and $L_{12}$ each having the unique voltage are excluded. Therefore, this LCD drive method can shift the contrast stripe, due to the unique voltage, outside the display area and can prevent the occurrence of the contrast stripe within the display area, thereby achieving improved even display with high quality.

There are described above novel features which the skilled man will appreciate give rise to advantages. These are each independent aspects of the invention to be covered by the present application, irrespective of whether or not they are included within the scope of the following claims.

What is claimed is:

1. A driving method for a liquid crystal display having a liquid crystal, the liquid crystal responding to a root-mean-square voltage and being disposed between a plurality of row electrodes and a plurality of column electrodes, the row and column electrodes being arranged in a matrix form, said method comprising the steps of:

(a) applying a row select voltage to each of the row electrodes simultaneously, the row select voltage corresponding to an element of an orthogonal matrix and being either +1 or −1;

(b) conducting an exclusive-or operation with respect to each element of a row select vector and a display vector, the row select vector indicating the row select voltages by vector notation and the display vector indicating a display data by the vector notation, and conducting a summation of each exclusive-or operation;

(c) applying to the column electrode a voltage of a level which varies depending on the summation so as to simultaneously drive the plurality of row electrodes; and (d) in a case where all the display data correspond to ON display or OFF display in the step (c), assigning the row select voltage, applied to either the selected row electrode having the lowest select voltage among driving voltages within one frame period for the ON display or the selected row electrode having the highest select voltage among the driving voltages within one frame period for the OFF display, to a virtual row electrode outside a display area, and applying a virtual display data to the virtual row electrode.

2. The driving method for a liquid crystal display as defined in claim 1, wherein when there are in the step (d) a plurality of selected row electrodes either having the lowest select voltage within one frame period for the ON display or having the highest select voltage within one frame period for the OFF display, each row select voltage applied to the plurality of selected row electrodes is assigned to each virtual row electrode outside the display area, and applying each virtual display data to each of virtual row electrodes.

3. The driving method for a liquid crystal display as defined in claim 1, wherein the row electrodes are composed of seven (7) row electrodes including the virtual row electrode.

4. The driving method for a liquid crystal display as defined in claim 2, wherein the row electrodes are composed of fifteen (15) row electrodes including the virtual row electrodes.

5. A liquid crystal display device comprising:

a liquid crystal display having a liquid crystal, the liquid crystal responding to a root-mean-square voltage and being disposed between a plurality of row electrodes arranged and a plurality of column electrodes, the row and column electrodes being arranged in a matrix form;

a row driver for successively selecting a plurality of row electrodes, and for applying a row select voltage to each of said plurality of row electrodes and a virtual row electrode outside a display area;

an orthogonal function producer for producing a row select signal in accordance with the row select voltage with use of an orthogonal matrix;

a frame memory for storing both display data for said plurality of row electrodes and a virtual display data for the virtual row electrode for each frame;

a plurality of EX-OR gates for conducting an exclusive-or operation with respect to each element of a row select vector and a display vector, the row select vector indicating the row select voltages by vector notation and the display vector indicating a display data and the virtual display data by the vector notation;

an adder for conducting a summation of each exclusive-or operation; and a column driver for applying to the column electrode a voltage of a level which varies depending on the summation, wherein, in a case where all the display data correspond to ON display or OFF display, the row select voltage, applied to either the selected row electrode having the lowest select voltage among driving voltages within one frame period for the ON display or the selected row electrode having the highest select voltage among the driving voltages within one frame period for the OFF display, is assigned to a virtual row electrode outside a display area, and a virtual display data is applied to the virtual row electrode.

6. The liquid crystal display device as defined in claim 5, wherein the number of said virtual row electrode is plural.

7. The liquid crystal display device as defined in claim 5, wherein the number of said EX-OR gates is seven (7), and the number of the row electrodes to which the respective row select voltages are simultaneously applied by said row driver is 7 including said virtual row electrode.

8. The liquid crystal display device as defined in claim 6, wherein the number of said EX-OR gates is 15, and the number of the row electrodes to which the respective row select voltages are simultaneously applied by said row driver is 15 including said virtual row electrodes.

* * * * *